US007752974B2

(12) United States Patent
Wenaas et al.

(10) Patent No.: US 7,752,974 B2
(45) Date of Patent: Jul. 13, 2010

(54) SYSTEMS, METHODS AND APPARATUS FOR USE IN DISTRIBUTING IRRITANT POWDER

(75) Inventors: Eric P. Wenaas, Rancho Santa Fe, CA (US); Edward J. Vasel, San Diego, CA (US); Joseph L. Goode, Escondido, CA (US)

(73) Assignee: Pepperball Technologies, Inc., San Diego, CA (US)

( * ) Notice: Subject to any disclaimer, the term of this patent is extended or adjusted under 35 U.S.C. 154(b) by 0 days.

(21) Appl. No.: 12/233,511

(22) Filed: Sep. 18, 2008

(65) Prior Publication Data

US 2009/0071459 A1 Mar. 19, 2009

Related U.S. Application Data

(63) Continuation of application No. PCT/US2008/076739, filed on Sep. 17, 2008.

(60) Provisional application No. 60/973,447, filed on Sep. 18, 2007.

(51) Int. Cl.
*F41B 11/00* (2006.01)
*B67D 7/00* (2010.01)

(52) U.S. Cl. ..... 102/367; 124/61; 124/64; 222/3; 222/5; 222/389; 222/399; 222/394

(58) Field of Classification Search ..... 102/502, 102/367; 42/1.08, 1.15; 124/61, 64, 74, 124/71; 222/3, 4, 5, 389, 399, 391, 394
See application file for complete search history.

(56) References Cited

U.S. PATENT DOCUMENTS 556,058 A 3/1896 Huey
1,461,600 A 7/1923 Cottrell (Continued)

FOREIGN PATENT DOCUMENTS

DE 4321041 1/1995

(Continued)

OTHER PUBLICATIONS

Advisory Action from U.S. Appl. No. 90/008,728 mailed Feb. 3, 2009.

(Continued)

*Primary Examiner*—Michael Carone
*Assistant Examiner*—Daniel J Troy
(74) *Attorney, Agent, or Firm*—Richard D. Clarke

(57) ABSTRACT

The present embodiments provide apparatuses for use in launching an inhibiting powder. These embodiments comprise a source of impulse pressure that induces a propellant pressure, a barrel cooperated with the source of impulse pressure to receive the propellant pressure, inhibiting powder positioned within an interior of the barrel, a burst diaphragm secured between the source of the impulse pressure and the inhibiting powder, and an actuator that activates the source of impulse pressure to deliver an expanding gas producing an increasing pressure that is applied to the burst diaphragm where the burst diaphragm bursts when the applied pressure exceeding a burst threshold, resulting in a release of the propellant pressure into the barrel to drive the inhibiting powder from the barrel in substantially an aerosol form generating a cloud of inhibiting powder.

23 Claims, 14 Drawing Sheets

U.S. PATENT DOCUMENTS 1,517,554 A 12/1924 Fulcher
1,671,364 A 5/1928 Arnt
1,741,901 A 12/1929 Alden
1,920,257 A 8/1933 Hallard
2,096,698 A 10/1937 Lowy et al.
2,112,758 A 3/1938 Blacker
2,172,800 A 9/1939 Manville
2,573,362 A 10/1951 Rouse
2,660,993 A 12/1953 Blakeslee
2,725,048 A 11/1955 Koogle
2,817,328 A 12/1957 Gale
2,920,566 A 1/1960 Barker
2,964,031 A 12/1960 Dotson
2,986,072 A 5/1961 Hudson
3,094,934 A 6/1963 Anthony
3,142,293 A 7/1964 Harter
3,156,187 A 11/1964 Baton
3,417,719 A 12/1968 Nitenson
3,419,274 A 12/1968 Tabor
3,431,853 A 3/1969 Mantone et al.
3,528,662 A 9/1970 Merchant et al.
3,630,151 A 12/1971 Rakowsky
3,649,020 A 3/1972 Hall
3,650,213 A 3/1972 Abbott et al.
3,665,803 A 5/1972 Forsten et al.
3,707,793 A 1/1973 Holton
3,707,918 A 1/1973 Dunfee et al.
3,732,821 A 5/1973 Royer
3,738,271 A 6/1973 LaCosta
3,776,137 A 12/1973 Abbott
3,782,286 A 1/1974 Jones et al.
3,791,303 A 2/1974 Sweeney et al.
3,830,214 A 8/1974 Curtis
3,848,532 A 11/1974 Abbott
3,865,038 A 2/1975 Barr
3,882,780 A 5/1975 Gawlick et al.
3,889,652 A 6/1975 Curtis
3,895,579 A 7/1975 Gawlick et al.
3,898,932 A 8/1975 Flatau et al.
3,899,974 A 8/1975 Harnau
3,901,158 A 8/1975 Ferb
3,911,824 A 10/1975 Bbarr et al.
3,921,614 A 11/1975 Fogelgren
3,951,070 A 4/1976 Flatau
3,952,658 A 4/1976 Broyles
3,952,662 A 4/1976 Greenlees
3,978,791 A 9/1976 Lemley et al.
3,980,023 A 9/1976 Misevich
3,983,817 A 10/1976 Tucker
4,150,656 A 4/1979 Curran
4,223,804 A 9/1980 Morris et al.
4,250,742 A 2/1981 Kopf
4,446,990 A * 5/1984 Stevenson et al. ..... 222/82
4,449,474 A 5/1984 Mariol
4,505,336 A 3/1985 Thevis et al.
4,598,096 A 7/1986 Grant
4,667,601 A 5/1987 Diamond et al.
4,684,137 A 8/1987 Armer et al.
4,686,905 A 8/1987 Szabo
4,696,347 A 9/1987 Stolov et al.
4,798,143 A 1/1989 Graham
4,895,076 A 1/1990 Looger et al.
4,899,660 A 2/1990 Brighton
4,932,329 A 6/1990 Logie
4,944,521 A 7/1990 Greeno
4,976,202 A 12/1990 Honigsbaum
5,009,164 A 4/1991 Grinberg
5,009,165 A 4/1991 Morris
5,018,449 A 5/1991 Eidson
5,035,183 A 7/1991 Luxton
5,076,607 A 12/1991 Woods et al.
5,078,117 A 1/1992 Cover
5,221,809 A 6/1993 Cuadros
5,230,324 A 7/1993 Van Horssen et al.
5,272,981 A 12/1993 Badura et al.
5,353,712 A 10/1994 Olson
5,353,779 A 10/1994 Lyon
5,361,524 A * 11/1994 Karkau et al. ..... 42/1.16
5,361,700 A 11/1994 Carbone
5,365,913 A 11/1994 Walton
5,402,729 A 4/1995 Richert
5,450,795 A 9/1995 Adelman
5,460,154 A 10/1995 Mattern et al.
5,529,215 A 6/1996 Banks
5,529,300 A 6/1996 Frazier et al.
5,565,649 A 10/1996 Tougeron et al.
5,640,945 A 6/1997 Slonaker et al.
5,652,405 A 7/1997 Rakov
5,671,559 A 9/1997 Ludaesher et al.
5,715,803 A 2/1998 Mattern
5,727,538 A 3/1998 Ellis
5,732,752 A 3/1998 Glessner et al.
5,743,246 A 4/1998 Mattern
5,762,057 A 6/1998 Laabs et al.
5,791,327 A 8/1998 Riggs et al.
5,832,911 A 11/1998 Mayville et al.
5,909,000 A 6/1999 Rakov
5,965,839 A 10/1999 Vasel et al.
6,003,504 A 12/1999 Rice et al.
6,041,712 A 3/2000 Lyon
6,047,644 A 4/2000 Malecki et al.
6,065,404 A 5/2000 Ripingill et al.
6,142,137 A 11/2000 McLaughlin
6,145,441 A 11/2000 Woodall et al.
6,209,461 B1 4/2001 Riffet et al.
6,223,658 B1 5/2001 Rosa et al.
6,250,226 B1 6/2001 Leichter et al.
6,283,037 B1 9/2001 Sclafani
6,302,028 B1 10/2001 Guillot-Ulmann
6,374,741 B1 4/2002 Stanley et al.
6,393,992 B1 5/2002 Vasel
6,412,416 B1 * 7/2002 Rouse et al. ..... 102/336
6,439,216 B1 8/2002 Johnson et al.
6,532,947 B1 3/2003 Rosa et al.
6,543,365 B1 4/2003 Vasel et al.
6,546,874 B2 4/2003 Vasel et al.
6,615,815 B1 9/2003 Liang
6,619,211 B1 9/2003 Haeselich
6,669,530 B2 12/2003 Du
6,675,789 B2 1/2004 Pearce et al.
6,997,110 B2 2/2006 Rastegar
7,021,219 B1 4/2006 Dindle
7,086,337 B2 8/2006 Klein
7,143,699 B2 12/2006 Brock et al.
7,194,960 B2 3/2007 Vasel et al.
7,337,774 B2 3/2008 Webb
7,412,975 B2 8/2008 Dillon, Jr.
7,526,998 B2 5/2009 Vasel et al.
2001/0045173 A1 11/2001 Gibson et al.
2002/0129728 A1 9/2002 Vasel et al.
2002/0129806 A1 9/2002 Kim
2003/0047105 A1 3/2003 Vasel et al.
2004/0016048 A1 1/2004 Allenbaugh et al.
2004/0069177 A1 4/2004 Klein
2005/0011507 A1 1/2005 Webb
2005/0016412 A1 1/2005 Vasel et al.
2005/0066841 A1 3/2005 Vasel et al.
2005/0188886 A1 9/2005 Vasel et al.
2006/0011090 A1 * 1/2006 Vasel et al. ..... 102/512
2006/0027223 A1 2/2006 Vasel et al.
2006/0032393 A1 2/2006 Haeselich 2006/0225600 A1 10/2006 Skellern et al.

FOREIGN PATENT DOCUMENTS

| | | | |
|---|---|---|---|
| EP | 1043562 | A2 | 10/2000 |
| FR | 2712686 | A1 | 5/1995 |
| FR | 2712686 | A1 | 5/1995 |
| WO | WO/9428371 | | 10/1994 |
| WO | WO/9500814 | | 1/1995 |
| WO | WO9500814 | A1 | 1/1995 |
| WO | 9523952 | A | 9/1995 |
| WO | WO/9914551 | | 3/1999 |
| WO | WO-9914551 | | 3/1999 |
| WO | WO9914551 | | 3/1999 |
| WO | WO-0053999 | | 9/2000 |

OTHER PUBLICATIONS

Final Office Action for U.S. Appl. No. 11/129,230 mailed Feb. 11, 2009.
Non Final Office Action from U.S. Appl. No. 12/237,317 mailed Mar. 6, 2009.
Supplemental European Search Report, 90 098 a/fi, Feb. 25, 2005.
Interview Summary from U.S. Appl. No. 08/751,709 dated Jan. 21, 1999.
Interview Summary from U.S. Appl. No. 08/751,709 dated Oct. 16, 1998.
Interview Summary from U.S. Appl. No. 09/289,258 dated Dec. 5, 2001.
Interview Summary from U.S. Appl. No. 09/289,258 dated Oct. 31, 2001.
Interview Summary from U.S. Appl. No. 09/289,258 dated Sep. 21, 2001.
Interview Summary from U.S. Appl. No. 09/289,258 dated Jul. 19, 2001.
Interview Summary from U.S. Appl. No. 10/866,031 dated Nov. 8, 2006.
Interview Summary from U.S. Appl. No. 10/866,031 dated Feb. 9, 2007.
Notice of Allowance from U.S. Appl. No. 10/866,031 dated Feb. 22, 2007.
Response to Rule 312 from U.S. Appl. No. 10/146,013 dated Mar. 5, 2003.
Preliminary Report on Patentablity, PCT/US2005/016657, mail date Nov. 23, 2006 International Bureau of WIPO.
International Search Report, PCT/US2004/03640, mail date Dec. 12, 2006.
Office Action U.S. Appl. No. 11/129,230 dated Aug. 3, 2007.
Preliminary Report on Patentability PCT/US04/003640 mail date Dec. 6, 2006.
International Search Report WO06033677 mail date Jun. 27, 2006.
International Preliminary Report on Patentability WO06033677 issued Nov. 14, 2006.
Written Opinion of the International Searching Authority WO06033677 mail date Jun. 27, 2006.
Notice of Allowance for U.S. Appl. No. 09/289,258 mailed Jan. 9, 2002.
Examiner Interview Summary for U.S. Appl. No. 09/289,258 mailed Nov. 13, 2001.
Examiner Interview Summary for U.S. Appl. No. 09/289,258 mailed Nov. 6, 2001.
Examiner Interview Summary for U.S. Appl. No. 09/289,258 mailed Sep. 26, 2001.
Examiner Interview Summary for U.S. Appl. No. 09/289,258 mailed Jan. 9, 2002.
Examiner Interview Summary for U.S. Appl. No. 09/289,258 mailed Jul. 23, 2001.
Non Final Office Action from U.S. Appl. No. 10/953,055 mailed Mar. 24, 2008.
International Search Report + Written Opinion, PCT/US05/11999, mail date Sep. 13, 2007.
Office Action from U.S. Appl. No. 11/691,415 dated Aug. 17, 2007.
Non Final Office for U.S. Appl. No. 11/102,297 mailed Apr. 9, 2008.
Re-Exam Final Office Action for U.S. Appl. No. 90/008,728 maled Nov. 14, 2008.
Office Action from U.S. Appl. No. 09/826,717 mailed May 24, 2002 Found in investigation matter.
Re-Exam Non Final Office Action for U.S. Appl. No. 90/008,728 mailed Jan. 3, 2008.
Re-Exam Non Final Office Action for U.S. Appl. No. 90/008,731 mailed Jan. 11, 2008.
Re-Exam Final Office Action for U.S. Appl. No. 90/008,731 mailed Nov. 7, 2008.
European Examination Report for EP App. No. 99 120 808.3-2304 mailed Apr. 1, 2005.
European Examination Report for EP App. No. 99 120 808.3-2304 mailed Apr. 26, 2006.
European Search Report for EP App. No. 99 120 808.3-2304 mailed May 14, 2001.
EP Search Report for App. No. 00937513.0 dated Feb. 25, 2005.
EP Office Action for App. No. 00937513.0 dated Nov. 16, 2004.
EP Office Action for App. No. 00937513.0 dated Feb. 15, 2006.
International Application Publication and Internatinal Search Report for PCTUS0009331 mailed Dec. 27, 2000.
International Search Report and Written Opinion of the International Searching Authority for PCTUS0516686 mailed Jan. 2, 2008.
""Universal Guardian Acquired by Hollywood Partners"", *Press Release from Universal Guardian Holdings, Inc., Los Angeles Business Wire* Dec. 6, 2002.
"Addendum to defendants' reply in support of motion to stay proceedings", *Pepperball Technologies Inc.* v. *Security with Advanced Technology, Inc. et.al.,* 07cv0672JAH(POR) Oct. 3, 2007.
"An Open Letter to Law Enforcement Personnel: When is less-than-lethal force appropriate?", *Universal Guardian's Training Team* , Jun. 14, 2002.
"Complaint for Patent Infringement and Breach of Contract", *Pepperball Technologies Inc.* v. *Security with Advanced Technology, Inc. et.al.,* 07cv0672JAH(POR) Apr. 13, 2007.
"Declaration of Christin Lewis in opposition todefendants' motion to stay proceedings", *Pepperball Technologies Inc.* v. *Security with Advanced Technology, Inc. et.al.,* 07cv0672JAH(POR) Aug. 30, 2007.
"Declaration of Eric P. Wenaas in opposition to defendants' motion to stay proceedings", *Pepperball Technologies Inc.* v. *Security with Advanced Technology, Inc. et.al.,* 07cv0672JAH(POR) Aug. 30, 2007.
"Declaration of Fletcher W. Paddison in support of defendants' addendum to reply in support of motion to stay proceedings", *Pepperball Technologies Inc.* v. *Security with Advanced Technology, Inc. et.al.,* 07cv0672JAH(POR) Oct. 3, 2007.
"Declaration of Fletcher W. Paddison in support of defendants' motion to stay proceedings pending the resolution of the reexamination proceeding relating to United States patent Nos. 7194960 and 6393992", *Pepperball Technologies Inc.* v. *Security with Advanced Technology, Inc. et.al.,* 07cv0672JAH(POR) Jul. 2, 2007.
"Declaration of Fletcher W. Paddison in support of defendants' reply in support of motion to stay proceedings", *Pepperball Technologies Inc.* v. *Security with Advanced Technology, Inc. et. al.,* 07cv0672JAH(POR) Sep. 10, 2007.
"Declaration of Fletcher W. Paddison in support of defendants' response in opposition to plaintiff's motion to dismiss defendants' second counterclaim", *Pepperball Technologies Inc.* v. *Security with Advanced Technology, Inc. et.al.,* 07cv0672JAH(POR) Aug. 31, 2007.
"Declaration of Scott Sutton in support of defendants' motion to dismiss plaintiff's complaint for patent infringement of United States patent Nos. 6546874 and 6543365", *Pepperball Technologies Inc.* v. *Security with Advanced Technology, Inc. et.al.,* 07cv0672JAH(POR) Jun. 4, 2007.
"Declaration of Stewart M. Brown in opposition to defendants' motion to stay proceedings", *Pepperball Technologies Inc.* v. *Security with Advanced Technology, Inc. et.al.,* 07cv0672JAH(POR) Aug. 30, 2007.
"Declaration of Timothy R. Beyer in support of defendants' motion to dismiss plaintiff's complaint for patent infringement of United States patent Nos. 6546874 and 6543365", *Pepperball Technologies*

*Inc.* v. *Security with Advanced Technology, Inc. et.al.*, 07cv0672JAH(POR) Jun. 4, 2007.
"Defendants' answer, affirmative defenses, and counterclaims to first amended complaint", *Pepperball Technologies Inc.* v. *Security with Advanced Technology, Inc. et.al.*, 07cv0672JAH(POR) Jul. 2, 2007.
"Defendants' Memorandum of Points and Authorities in Support of their Motion to Dismiss Plaintiff's Complaint for Patent Infringement of United States patent Nos. 6546874 and 6543365", *Pepperball Technologies Inc.* v. *Security with Advanced Technology, Inc. et.al.*, 07cv0672JAH(POR) Jun. 4, 2007.
"Defendants' memorandum of points and authorities in support of their motion to stay proceedings pending the resolution of the reexamination proceeding relating to United States patent Nos. 7194960 and 6393992", *Pepperball Technologies Inc.* v. *Security with Advanced Technology, Inc. et.al.*, 07cv0672JAH(POR) Jul. 2, 2007.
"Defendant's motion to dismiss plaintiff's complaint for patent infringement of United States patent Nos. 6546874 and 6543365", *Pepperball Technologies Inc.* v. *Security with Advanced Technology, Inc. et.al.*, 07cv0672JAH(POR) Jun. 4, 2007.
"Defendants' motion to stay proceedings pending the resolution of the reexamination proceeding relating to United States patent Nos. 7194960 and 6393992", *Pepperball Technologies Inc.* v. *Security with Advanced Technology, Inc. et.al.*, 07cv0672JAH(POR) Jul. 2, 2007.
"Defendants' reply in support of motion to stay proceedings", *Pepperball Technologies Inc.* v. *Security with Advanced Technology, Inc. et.al.*, 07cv0672JAH(POR) Sep. 10, 2007.
"Defendants' request to withdraw motion to dismiss and vacate hearing", *Pepperball Technologies Inc.* v. *Security with Advanced Technology, Inc. et.al.*, 07cv0672JAH(POR) Jun. 29, 2007.
"Defendants' response in opposition to plaintiff's motion to dismiss defendants' second counterclaim", *Pepperball Technologies Inc.* v. *Security with Advanced Technology, Inc. et.al.*, 07cv0672JAH(POR) Aug. 31, 2007.
"First amended complaint for patent infringement and breach of contract", *Pepperball Technologies Inc.* v. *Security with Advanced Technology, Inc. et.al.*, 07cv0672JAH(POR) Jun. 19, 2007.
"Healthful Products for the Discriminating: What is Capsicum and what are it's possible Health Benefits?", *Brentwood Health International* http://www.emuhealthproducts.com/capsicum.html Apr. 2, 2003.
"Memorandum of points and authorities in support of plaintiff's motion to dismiss defendants' second counterclaim", *Pepperball Technologies Inc.* v. *Security with Advanced Technology, Inc. et.al.*, 07cv0672JAH(POR) Jul. 24, 2007.
"Non-Lethal Personal Protection devices from www.shielddefense.com", printed Oct. 29, 2004.
"Notice of Abandonment from U.S. Appl. No. 10/382,295 dated Aug. 25, 2004".
"Notice of Allowance from U.S. Appl. No. 08/751,709 dated Feb. 19, 1999".
"Notice of Allowance from U.S. Appl. No. 09/543,289 dated Jun. 3, 2002".
"Notice of Allowance from U.S. Appl. No. 09/289,258 dated Feb. 11, 2002".
"Notice of Allowance from U.S. Appl. No. 10/146,031 dated Nov. 6, 2002".
"Notice of Allowance from U.S. Appl. No. 10/866,031 dated Nov. 15, 2006".
"Notice of Defendants' Motion to Dismiss Plaintiff's Complaint for Patent Infringement of United States patent Nos. 6546874 and 6543365", *Pepperball Technologies Inc.* v. *Security with Advanced Technology, Inc. et.al.*, 07cv0672JAH(POR) Jun. 4, 2007.
"Notice of Defendants' motion to stay proceedings pending the resolution of the reexamination proceeding relating to United States patent Nos. 7194960 and 6393992", *Pepperball Technologies Inc.* v. *Security with Advanced Technology, Inc. et.al.*, 07cv0672JAH(POR) Jul. 2, 2007.
"Notice of defendants' request to withdraw motion to dismiss", *Pepperball Technologies Inc.* v. *Security with Advanced Technology, Inc. et.al.*, 07cv0672JAH(POR) Jun. 26, 2007.
"Office Action from U.S. Appl. No. 08/751,709 dated Mar. 23, 1998".
"Office Action from U.S. Appl. No. 08/751,709 dated Sep. 16, 1998".
"Office Action from U.S. Appl. No. 08/751,709 dated Dec. 16, 1997".
"Office Action from U.S. Appl. No. 09/543,289 dated Feb. 13, 2002".
"Office Action from U.S. Appl. No. 09/289,258 dated Sep. 26, 2001".
"Office Action from U.S. Appl. No. 09/869,258 dated Feb. 23, 2001".
"Office Action from U.S. Appl. No. 10/146,031 dated Jul. 15, 2002".
"Office Action from U.S. Appl. No. 10/382,295 dated Feb. 10, 2004".
"Office Action from U.S. Appl. No. 10/382,295 dated Jul. 21, 2003".
"Office Action from U.S. Appl. No. 10/866,031 dated Jun. 8, 2006".
"Office Action from U.S. Appl. No. 10/866,031 dated Nov. 16, 2004".
"Office Action from U.S. Appl. No. 10/866,031 dated Nov. 21, 2005".
"Office Action from U.S. Appl. No. 10/208,727 dated Apr. 28, 2004".
"Office Action from U.S. Appl. No. 10/208,727 dated Nov. 3, 2003".
"Oloeoresin Capsicum, http://zarc.com/english/cap-stun/tech_info/oc", 21 pages retrieved Feb. 24, 2008.
"Order denying plaintiff's motin to strike and granting plaintiff's rrequest to file a response to defendant's addendum", *Pepperball Technologies Inc.* v. *Security with Advanced Technology, Inc. et.al.*, 07cv0672JAH(POR) Oct. 5, 2007.
"Order granting defendants' request to withdraw motion to dismiss and vacate hearing", *Pepperball Technologies Inc.* v. *Security with Advanced Technology, Inc. et.al.*, 07cv0672JAH(POR) Jul. 10, 2007.
"Order Granting Defendants/Counter-claimants motion to stay and Denying without prejudice Plaintiffs' motion to dismiss, *Pepperball Technologies Inc.* v. *Securities with Advanced Technologies, Inc., et al.*", Civil No. 07cv0672JAH(POR) Feb. 13, 2008.
"Order Granting Request for Ex Parte Reexamination from U.S. Appl. No. 90/008,728 dated Sep. 20, 2007".
"Order Granting Request for Ex Parte Reexamination from U.S. Appl. No. 90/008,731 dated Sep. 24, 2007".
"Pachyderm No. 20, 1995", *Issue cover and comment on the date stamp from the Wildlife Conservation Society.*
"Pachyderm, No. 20, 1995", *Entire issue.*
"Pachyderm, No. 21, 1996", *Entire Issue.*
"Pareklese Technologies Product List", www.pareklesetechnologies.com Jan. 12, 2005 , 1-24.
"Patten Report Recommendations 69 and 70 Relating to the Public Order Equipment", *A paper prepared by the Steering Group led by the Northern Ireland Office* http://www.nio.gov.jk/pdf/phase1report.pdf Apr. 2001 , 12.
"Pepperball's reply to defendants' first counterclaim (declaratory judgment)", *Pepperball Technologies Inc.* v. *Security with Advanced Technology, Inc. et.al.*, 07cv0672JAH(POR) Jul. 24, 2007.
"Plaintiff Pepperball Technologies, Inc.'s notice of motion and motion to dismiss defendants' second counterclaim", *Pepperball Technologies Inc.* v. *Security with Advanced Technology, Inc. et.al.*, 07cv0672JAH(POR) Jul. 24, 2007.
"Plaintiff Pepperball Technologies, Inc.'s opposition to defendants' motion to stay proceedings", *Pepperball Technologies Inc.* v. *Security with Advanced Technology, Inc. et.al.*, 07cv0672JAH(POR) Aug. 30, 2007.
"Plaintiff's objection to and motion to strike addendum to defendants' reply in support of motion to stay proceedings", *Pepperball Technologies Inc.* v. *Security with Advanced Technology Inc. et.al.*, 07cv0672JAH(POR) Oct. 4, 2007.
"Plaintiff's objections to and motion to strike portions of the declaration of Scott Sutton in support of defendants' reply in support of motion to stay proceedings", *Pepperball Technologies Inc.* v. *Security with Advanced Technology, Inc. et.al.*, 07cv0672JAH(POR) Sep. 11, 2007.
"Plaintiff's response to addendum to defendants' reply in support of motion to stay proceedings", *Pepperball Technologies Inc.* v. *Security with Advanced Technology, Inc. et.al.*, 07cv0672JAH(POR) Oct. 9, 2007.
"Police Dropping 'Nonlethal' Beanbags as Too Dangerous", *Universal Guardian Holdings Inc., from the LA Times* Jun. 3, 2002.
"Replacement Request for Ex Parte Reexamination from U.S. Appl. No. 10/866,031 dated Jun. 10, 2004".
"Replacement Request for Reexamination from U.S. Appl. No. 09/289,258 dated Apr. 9, 1999".
"Reply memorandum of points and authorities in support of plaintiff's motion to dismiss defendants' second counterclaim", *Pepperball Technologies Inc.* v. *Security with Advanced Technology, Inc. et.al,* 07cv0672JAH(POR) Sep. 10, 2007.

"Response to plaintiff's objections to and motion to strike portions of declaration of Scott Sutton in support of defendants' reply in support of motion to stay proceedings", *Pepperball Technologies Inc.* v. *Security with Advanced Technology, Inc. et.al.,* 07cv0672JAH(POR) Sep. 13, 2007.
"Universal Guardian Holdings, Inc. Announces Appointments to its Board of Directors", *Press Release from Universal Guardian Holdings, Inc.* Jan. 21, 2003.
"Universal Guardian Holdings, Inc. Products and Services from Winter Catalog 2002-2003, Executive Managment, Directors and Advisors Biographies", www.universalguardian.com, printed Mar. 12, 2003.
Christensen, et al., "Preliminary Investigation of Oleoresin Capsicum", *National Institute of Justice Report* 100-95 1995 1995 , 1-11.
Constant, et al., "Nonivamide, a Constituent of Capsicum oleoresin", *J. Nat. Prod.* vol. 59(4) 1996 , 425-426.
Ingram, Carl , "Bill Would Let Public Buy New Pepper Weapon", *Los Angeles Times* B1 and B11 2001 , B1 and B11.
Osborn, F. V. , "Evidence For The Effectiveness Of An Oleo-Resin Capsicum Aerosol as a Repellent against Wild Elephants in Zimbabwe", *Pachyderm*, No. 20, 1995, from an Internet Scholar Google search.
Punte, Charles , "Toxicologic Studies on o-Chlorobenzylidene Malononitrile", *Army Chemical Research and Development Laboratories* Jan. 12, 1961.
Reilly, et al., "Quantitative Analysis of Capsaicinoids in Fresh Peppers, Oleoresin Capsicum and Pepper Spray Products", *Journal of Forensic Sciences*, 46(3) 2001 , 502-509.
U.S.P.T.O., Office Action from U.S. Appl. No. 10/731,684 mailed Aug. 8, 2008.
U.S.P.T.O., Advisory Action for U.S. Appl. No. 10/731,684 dated Nov. 17, 2008.
Vasel, U.S. Appl. No. 90/008,728, filed Aug. 13, 2007.
Vasel, U.S. Appl. No. 90/008,731, filed Aug. 15, 2007.
Vasel, et al., U.S. Appl. No. 08/751,709, filed Nov. 18, 1996.
Vasel, et al., U.S. Appl. No. 09/289,258, filed Apr. 9, 1999.
Vasel, et al., U.S. Appl. No. 09/543,289, filed Apr. 5, 2000.
Vasel, et al., U.S. Appl. No. 10/146,013, filed May 14, 2002.
Vasel, et al., U.S. Appl. No. 10/208,727, filed Jul. 29, 2002.
Vasel, et al., U.S. Appl. No. 10/382,295, filed Mar. 4, 2003.
Vasel, et al., U.S. Appl. No. 10/731,684, filed Dec. 8, 2003.
Vasel, et al., U.S. Appl. No. 10/866,031, filed Jun. 10, 2004.
Vasel, et al., U.S. Appl. No. 10/953,055, filed Sep. 28, 2004.
Vasel, et al., U.S. Appl. No. 11/102,297, filed Apr. 8, 2005.
Vasel, et al., U.S. Appl. No. 11/129,230, filed May 12, 2005.
Vasel, et al., U.S. Appl. No. 11/568,968, filed Nov. 10, 2006.
Vasel, et al., U.S. Appl. No. 11/691,415, filed Mar. 26, 2007.
Zarc International, Inc., , "Cap-Stun OC Products: Oleoresin Extraction", http://www.zarc.com/english/cap-stun/techinfo/oc/oleoresin.html Apr. 23, 2003.
Notice of Allowance from U.S. Appl. No. 11/129,230 mailed Aug. 7, 2009.
Preliminary Report on Patentablity, PCT/US2005/016657, date of issuance of this report Nov. 14, 2006 International Bureau of WIPO.
International Search Report, PCT/US2004/03640, mail date Dec. 6, 2006.
International Written Opinion PCT/US04/003640 mail date Dec. 6, 2006.
International Search Report for PCTUS2004003640 issued Dec. 6, 2006.
International Preliminary Report on Patentability and Written Opinion of the International Searching Authority for PCT/US2005/011999 mailed Sep. 13, 2007.
Publication of International Search Report for PCT/US2005/011999 mailed Sep. 13, 2007.
Notice of Allowance from U.S. Appl. No. 10/731,684 mailed Dec. 31, 2008.
Final Office Action from U.S. Appl. No. 11/102,297 mailed Jan. 26, 2009.
International Search Report and Written Opinion of the International Searching Authority from PCTUS2008076739 mailed Mar. 11, 2009.
"Joint Motion to Dismiss All Claims and Counterclaims With Prejudice by Pepperball Technologies Inc.", *Pepperball Technologies Inc.* v. *Security with Advanced Technology, Inc. et al.* 07cv0672JAH(POR) Entered Feb. 11, 2009 Mulloy, Richard.
"Miller Manufacturing Product Detail", Oct. 20, 2008.
"Office Action from U.S. Appl. No. 10/146,013 dated Jul. 15, 2002".
"Order Dismissing All Claims and Counterclaims with Prejudice", *Pepperball Technologies Inc.* v. *Security with Advanced Technology Inc., et al.* Signed by Judge John A. Houston on 07cv0672JAH(POR) Feb. 12, 2009.
Non Final Office Action from U.S. Appl. No. 11/568,968 mailed May 26, 2009.
Re-exam Final Office Action from U.S. Appl. No. 90/008,728 mailed Nov. 14, 2008.
Re-exam Final Office Action from U.S. Appl. No. 90/008,728 mailed Dec. 12, 2008.
Re-exam Final Office Action from U.S. Appl. No. 90/008,731 mailed Nov. 7, 2008.
Notice of Allowance U.S. Appl. No. 11/129,230 mailed Jun. 30, 2009.

* cited by examiner

SYSTEMS, METHODS AND APPARATUS FOR USE IN DISTRIBUTING IRRITANT POWDER

PRIORITY CLAIM

This application claims the benefit of U.S. Provisional Application No. 60/973,447, filed Sep. 18, 2007, entitled NON-LETHAL IRRITANT POWDER CLOUD LOADS FOR PERSONAL DEFENSE LAUNCHERS, which is incorporated herein by reference in its entirety; and this application is a continuation of International Application No. PCT/US08/76739, filed Sep. 17, 2008, entitled SYSTEMS, METHODS AND APPARATUS FOR USE IN DISTRIBUTING IRRITANT POWDER, which claims the benefit of U.S. Provisional Application No. 60/973,447, filed Sep. 18, 2007, entitled NON-LETHAL IRRITANT POWDER CLOUD LOADS FOR PERSONAL DEFENSE LAUNCHERS, where International Application No. PCT/US08/76739 is also incorporated herein by reference in its entirety

FIELD OF THE INVENTION

The present invention relates generally to irritant powders, and more particularly to methods and systems of dispersing irritant powders.

BACKGROUND

For several decades, Law Enforcement agencies have used various non-lethal weapons to gain control of suspects, quell riots, save hostages, and the like. Many of these non-lethal weapons typically require a large launcher platform such as a shotgun, rifle or pistol to deploy projectiles. These generally large platforms can make the use of these launchers cumbersome in some circumstances.

To date, other than pepper spray, the general public typically has not had access to a simple, low cost, non-lethal projectile launcher. Further, there are generally no non-lethal projectile launchers that are easily carried and used for personal defense at home, in the car or when on foot.

SUMMARY OF THE EMBODIMENTS

The present invention advantageously addresses the needs above as well as other needs through the provision of the method, apparatus, and system for use in launching loose powder to generate a powdered cloud. Some embodiments provide apparatuses for use in launching an inhibiting powder. These embodiments comprise a source of impulse pressure that induces a propellant pressure; a barrel cooperated with the source of impulse pressure to receive the propellant pressure; inhibiting powder positioned within an interior of the barrel; a burst diaphragm secured between the source of the impulse pressure and the inhibiting powder; and an actuator that activates the source of impulse pressure to deliver an expanding gas producing an increasing pressure that is applied to the burst diaphragm where the burst diaphragm bursts when the applied increasing pressure exceeding a burst threshold of the burst diaphragm, where the bursting of the burst diaphragm results in a release of the propellant pressure into the barrel to drive the inhibiting powder from the barrel in substantially an aerosol form generating a cloud of inhibiting powder extending from an exit end of the barrel and out a distance from the exit end of the barrel.

Other embodiments provide launch systems. At least some of these launch systems comprise a frame; a source of impulse pressure cooperated with the frame; a barrel secured relative to the frame and cooperated with the source of impulse pressure to receive a propellant pressure from the source of impulse pressure; powder load positioned within an interior of the barrel, the powder load comprising a powdered inhibiting substance; a burst diaphragm secured between the source of the impulse pressure and the powder load, wherein the burst diaphragm retains the impulse pressure from the source of impulse pressure until a pressure of about equal to a burst threshold of the burst diaphragm such that the burst diaphragm bursts releasing a propellant pressure into the barrel to drive the powder load from the barrel in substantially an aerosol form generating a powder cloud of powder load extending from a exit end of the barrel.

Some embodiments provide methods of providing an individual with protection. These methods activate, in response to an actuation, a source of impulse pressure; launch loose powder from a launch system; and generate a powder cloud comprising the loose powder that has dimensions larger than a human torso.

A better understanding of the features and advantages of the present invention will be obtained by reference to the following detailed description of the invention and accompanying drawings which set forth an illustrative embodiment in which the principles of the invention are utilized.

BRIEF DESCRIPTION OF THE DRAWINGS

The above and other aspects, features and advantages of the present invention will be more apparent from the following more particular description thereof, presented in conjunction with the following drawings wherein.

Figure 1:
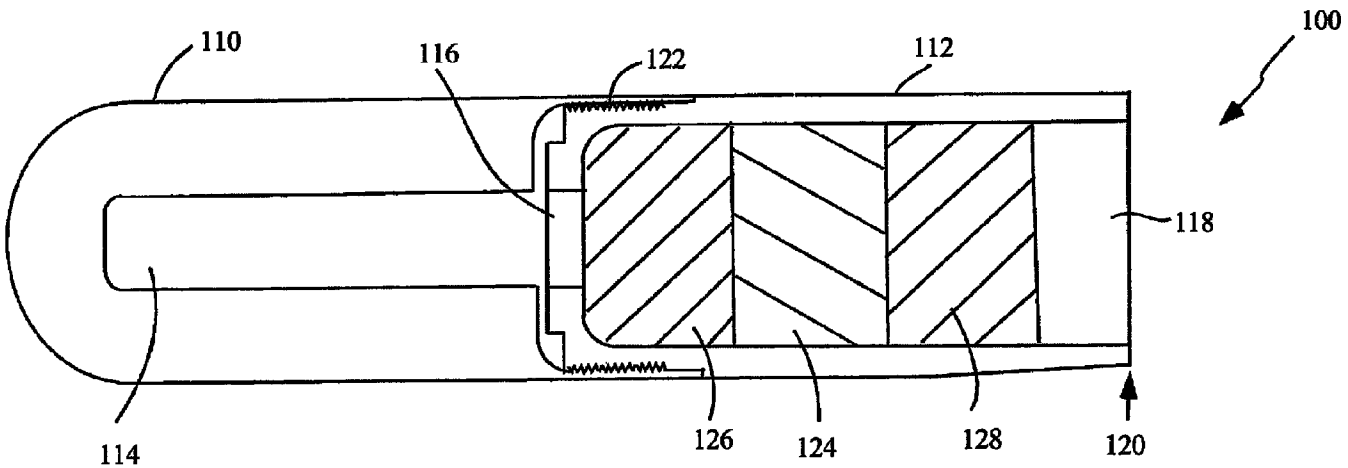
FIG. 1 depicts a simplified cross-sectional diagram of a launch system according to some embodiments.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The present embodiments provide a launching system or device that when activated expels a cloud of irritant powder towards a target, such as a threatening target, as a means of non-lethal defense and/or for subduing a target. This irritant cloud may have a distracting, incapacitating and/or repelling effect on the target, be it a human or animal. The irritant and distraction effects on the target may allow the user to retreat to a safer location, get away from an attacker, or if used by law enforcement or security personnel, subdue an individual for capture and/or arrest. The concept of a small handheld powder launch system can have many embodiments depending on the desired application. The basic operation, however, is typically similar. When threatened by an attacker or animal, for example, a user generally points or aims the launch system in the threat direction and activates the system, for example through a triggering mechanism, that results in the substantially instantaneous deployment of an irritant powder payload cloud and/or a non-lethal projectile towards the target.

There are many advantages to a device that deploys a simple blast of irritant cloud from the muzzle of a compact self defense launching system. In some embodiments, an irritant powder is launched towards the target(s) that generates a cloud comprised at least partially of the irritant powder with the intention that the cloud contacts the target(s) directly, drifting on air currents towards the target(s), or just placing a barrier irritant cloud between the user and the threat.

Therefore, the launching of a non-lethal powder, to generate a powder irritant cloud, launched from a compact system provides many advantages over conventional projectiles and/or other self defense devices. For example, a powder irritant cloud does not require a precise aim point on the target to affect the target such as with a projectile. Further, unlike most conventional projectiles, the powder irritant cloud can affect more than one threatening targets due to its relatively large volume and ability to float on the air currents. A powder irritant cloud can utilize a cross or back wind to further disperse its irritant towards distant target(s). Unlike solid projectiles, a powder irritant cloud can hang in the air and be an effective temporary barrier between the user and the threat, and unlike pepper spray the powder cloud typically is visible. Still further, devices that launch some projectiles, in some areas of the United States and the World, may be considered a weapon, e.g., launching a projectile carrying an inhibiting substances (such as some projectiles described in U.S. Pat. Nos. 7,194,960; 6,546,874; 6,393,992; and 5,965,839, and Patent Application Publication Nos. 2005/0188886 and 2006/0027223, all of which are incorporated herein by reference in their entirety) may be considered, in some areas of the United States or the World, a chemical weapon, while the launching of a loose powder that rapidly deploys into a cloud of inhibiting powder is not considered a weapon and can be carried and/or used by the general public and/or non-law enforcement individuals. Many other advantages are provided by a launch system that launches loose powder to generate a cloud of irritant powder as described below and will be apparent to those skilled in the art.

The powder launch systems of the present embodiments can utilize any number of different types of impulse energy sources to eject and/or otherwise launch the loose powder, including impulse sources employed within compact hand held devices. One or more of these different types of impulse energy sources are used in launch systems to propel the non-lethal powder loads of the present embodiments toward a target. For example, the impulse energy source can be from a launch system using the pressure impulse from a conventional firearm primer; an electrically fired primer; a burning gas generator common to automobile airbag technology; known gunpowder technology; by spark ignition of propane, butane or other hydrocarbons; sources of compressed gas such canisters, cylinders or cartridges of compressed gas (e.g., such as found in refillable paintball gas cylinders); replaceable compressed gas cartridges (e.g., cartridges such as used in air pistols and inflation devices); and other such sources of impulse pressure and/or combinations of sources of impulse pressure. For example, by utilizing disposable and/or replaceable compressed gas cartridges filled with air, nitrogen, carbon dioxide and/or other gases, some launch systems of the present embodiments may be fabricated as a disposable (e.g., one time use) launch system, and/or a portion of the launch system can be disposable and replaced in an easily reloadable launch system.

As described above, the launch systems according to some embodiments launch a loose powder that rapidly generates a cloud of powder extending from the launch system. Launch systems and/or method of some implementations can launch one load or multiple loads at a time or in succession. A launch system may be capable of one or multiple launchings through one or multiple barrels using various configurations. The launch systems of some embodiments provide a source of gas impulse in a barreled device. The choice of impulse gas energy can depend on many factors, such as but not limited to, desired design, launch system size and/or weight, desired powder cloud dispersion, size and/or weight of a launch load, and/or other application factors. As introduced above, the powder loads of the present embodiments can be utilized with many existing launchers, and/or launch systems utilizing impulse pressure mechanisms (e.g., impulse gas) designed specifically to launch irritant, non-lethal powder loads described herein.

FIG. 1 depicts a simplified cross-sectional diagram of a launch system 100 according to some embodiments. The launching system includes a frame or body 110 and a barrel assembly 112. Within the frame 110 is mounted a source of impulse pressure 114. The barrel assembly 112 includes an entry orifice or opening 116, a barrel or barrel bore 118 with an exit end 120 opposite from the entry opening 116. In some implementations, the frame 110 is removably mounted with the barrel assembly 112 such that the entry opening 116 is cooperated with the source of impulse pressure 114 allowing the impulse pressure to enter the barrel 118, upon activation of an actuator (not shown), providing a propellant pressure into the barrel 118. The removable mounting can include threading 122, spring loaded pins, pin and grooves and substantially any other such methods or combination of methods of securing that, at least temporarily, fixes the frame 110 with the barrel assembly 112 while the source of impulse pressure 114 generates and directs the impulse pressure into the barrel 118.

A powder load 124 comprising powder that is unenclosed and is positioned within the barrel 118. The powder load 124 is a loose powder load in that at least a majority of the powder 124 upon being ejected from the barrel 118 is loose and unenclosed to rapidly disperse into the powder cloud extending from substantially the exit end 120 of the barrel 118 as described above and further below. The powder load 124 is propelled, upon activation of the launch system 100, along the barrel 118 by the propulsion pressure and launched or ejected from the exit end 120 of the barrel assembly 112. In some implementations, a pusher or plunger 126 is positioned with the barrel 118 adjacent the powder load 124, between the source of impulse pressure 114 and the powder load 124 such that the propulsion force is directed against the pusher 126 to drive the pusher along the barrel 118, which in turn pushes the powder load 124 along and out of the barrel assembly 112. Typically, the pusher 126 is configured to establish a seal with the interior surface of the barrel 118 so that substantially all, and preferably all of the propulsion pressure does not leak around the pusher 126 and is thus substantially maintained behind the pusher 126. Further in some instances, the pusher 126 can be configured to provide equal distribution of the propulsion pressure and/or focus the propulsion pressure, for example, by including a rounded or tapered inlet, not shown, in the surface of the pushing that receives the propulsion pressure. In other embodiments, however, the pusher 126 is not included and the source of impulse pressure 114 directs the propulsion pressure directly on the powder load 124.

The pusher 126 can be configured from substantially any relevant material that can receive the propulsion pressure and travel along the barrel 118 to drive the powder load 124 from the barrel assembly 112 at a desired velocity. Further, it is desirable that the pusher 124 be relatively light weight so that it is rapidly decelerates upon leaving the barrel assembly 112 to fall to the ground, typically before reaching a target. Additionally and/or alternatively, the pushing can be configured to have a relatively large wind drag to aid in decelerating the pusher upon exiting the barrel assembly 112. The pusher 126 can be fabricated from any number of materials such as, but not limited to, urethane foam, polymer foam, Styrofoam, paper, cardboard, plastic, rubber, and/or other such similar materials or combinations of materials.

A seal or retaining member 128 can further be incorporated into the barrel 118 in some implementations to retain the powder load 124 within the barrel 118 and/or seal the powder load 124 within the barrel providing a barrier between the powder load and exterior environmental conditions. Typically, the seal 128 establishes a seal and/or is secured within the barrel 118 to establish a seal with the interior surface of the barrel 118 to protect the powder load 124 from the environment. The seal 128 is shown in FIG. 1 being positioned within the barrel 118; however, the seal can extend from the exterior of the barrel into the barrel. Additionally or alternatively, a cap or other structure (not shown) can be positioned on the exit end 120 of the barrel 118 and/or can extend into the barrel to provide, in part, an additional seal to keep foreign objects out of the barrel 118 and/or to provide an indication that the launch system 100 has not been activated and that the barrel assembly 112 contains a powder load 124 to be launched. Still other structures can be incorporated with the exit end 120 of the barrel 112 in those instances where a cap is not included to provide an indication of whether the barrel assembly 112 has been previously activated to launch the powder load.

The seal 128 (and/or cap when present) is also typically constructed to rapidly decelerate upon being driven from the barrel assembly 112, and can be fabricated from any number of materials such as, but not limited to, paper, cardboard, urethane foam, polymer foam, Styrofoam, plastic, rubber, wax, paraffin and/or other such similar materials or combinations of materials. In some implementations the seal 128 is further secured, such as glued to the interior surface of the barrel 118 to enhance and/or ensure the seal and to retain the powder load 124. The glue can be selected to readily break upon a sufficient pressure being applied by the propulsion pressure allowing the seal 128 to detach from the interior surface of the barrel 118 and be ejected from the barrel assembly 112. The glue can be substantially any relevant glue, and in some instances is waterproof or water resistant glue, such as but not limited to TiteBond III™ or other relevant waterproof and/or water resistant glues. Similarly, a retaining member, such as an O-ring, may be employed to maintain the positioning of the seal 128 (and/or pusher 126) within the barrel 118. Additionally or alternatively, the seal 128 can be constructed of a material, or be assembled with weakening features that allow the seal to at least partially break apart when the propulsion pressure drives the powder load 124 against the seal releasing the powdered load to be driven along and out of the barrel assembly 112.

The powder load 124 comprises a powder that is propelled along the barrel and ejected from the exit end 120 of the barrel assembly 112 in substantially an aerosol to generate a powdered cloud extending from the exit end 120 of the barrel toward a target, and in some instances about a target when the target is within range. The powder load 124, in some embodiments as depicted in FIG. 1, is free and loose and retained by the pusher 126, the seal 128 and the interior surface of the barrel 118 such that the powder load 124 is in contact with the interior surface of the barrel 118 prior to and while being driven along the barrel assembly 112 to be ejected from the exit end 120 of the barrel 118. Typically, when the barrel 118 is loaded with the pusher 126, and loose powder 124, the loose powder is in an uncompressed state, and in some instances is not packed or compressed when added to the barrel 118. In other embodiments, however, the loose powder may be partially tapped or compressed, may be inserted as a tablet, may be retained in a membrane or film prior to activation of the launch system 100, and/or other such configurations that are ejected from the barrel assembly 112 as loose powder in substantially a loose, free and in some instances an aerosol state.

The powder load 124, as described above, typically includes one or more powdered irritant and/or inhibiting substances. The irritating and/or inhibiting powder can comprise one or more irritants such as, but not limited to: one or more capsaicinoids; capsaicin; nonivamide; PAVA; oleoresin capsaicinoid (OC); a pepper derived irritant; powdered tear gas (CS or CN); and/or maloderants. The powder irritants may be naturally occurring or synthetically produced. In some implementations, the powder load 124 may be pure irritant powder or may be mixed with one or more types of inert powders to achieve a desired concentration of irritant effect on a target. Inert powders such as barium sulfate, baby powder, cornstarch, talc, trisodium phosphate, silicon dioxide, flour, baking powder, chalk, gypsum and/or similar non-toxic inert powders may be used to achieve the desired irritant concentration and give more visibility to the cloud. Relatively "heavy mass powders" such as barium sulfate or other similar non-toxic heavy powders may be added to the powder mixture to achieve a further launching or throw distance for the powder cloud in some implementations. Visually colored, ultraviolet (UV) fluorescent and/or other such marking powders may additionally or alternatively be also be used or added to the mixture to achieve a marking function if desired. Inert powder or inert powder mixture loads can also be used without adding the irritant powder for the purpose of a training or demonstration load that simulates the cloud performance of the irritant powder loads. The powder load 124 can comprise powder, in some implementations, as described in related U.S. Pat. Nos. 7,194,960; 6,546,874; 6,393,992; and 5,965,839, and Patent Application Publication Nos. 2005/0188886; and 2006/0027223, all of which are incorporated herein by reference in their entirety.

As described above, the powder load 124 is ejected from the exit end 120 of the barrel assembly 112 to generate the cloud of inhibiting powder. To achieve the desired cloud in some instances the powdered load 124 is expelled from the barrel assembly 112 as an aerosol that rapidly expands as it travels away from the barrel assembly 112 and launch system 100. The powder load configuration and/or particle sizes of the powder load can affect the aerosolizing effect. In some embodiments, an average particle size of at least the inhibiting powder portion of the powder load 124 is less than about 200 microns, and typically is less than about 100 microns, for example, the particle sizes can be between 5-100 microns, where smaller irritant powder particles typically aids in the hang time or time of suspension of the irritant powder particles and thus the cloud. Other components of the powder load may have larger particle sizes. For example, weighting particles may have larger sizes, where the weighting particles aid in dispersing the launched inhibiting powder.

The aerosolizing effect is also, at least in part, dependent on the amount of propulsion force applied and/or the speed at which the loose powder is propelled from the barrel assembly 112. In some implementations the propulsion force applied to the powder load 124 is greater than 200 psi, and typically greater than 400 psi. The amount of propulsion force is further dependent on the size and/or weight of the powder load 124 (and pusher 126 and seal 128 when relevant). For example, with a powder load 124 having a weight of about 5 grams, a propulsion force of over 700 psi can effectively launch the powder load, in some implementations, to generate an expanding cloud that is greater than about 8 feet deep extending from a position of the exit end 120 at the time of launch, and with a width (generally perpendicular to the depth at about 8 feet) of at least about 3 feet. Various cloud sizes, shapes and depths can be obtained by changing the elements and parameters of the launch system and/or load.

The powder load 124, typically, is a fine particle powdered substance such that the particle sizes or grain are less than 1000 microns in diameter, and preferably less than 500 microns, more preferably less than 250 microns, and in many instances less than 100 microns. It has been found that the generally the smaller the particle diameter in a powdered load 124, the more effective the dispersal, and typically the larger the volume of the dispersal, of the powder into a cloud upon being launched from the launch system 100. In some instances, the nature of the cloud produced is similar to, for example, a cloud that is formed when clapping erasers together, only generally much larger in volume. As will be seen, it is advantageous that the powder load 124 produce a fine cloud of the powder such that the cloud will be dispersed on and about the target, such that the target inhales the substance, and/or creates a relatively large suspended powder cloud barrier (e.g., larger than an adult human head, adult human torso or adult human body).

As described above, the powder load 124 can include an inhibiting substance, and in some instances comprises a powdered oleoresin capsicum powder or capsaicin powder that has a particle size of less than 500 microns, preferably less than 100 microns, and more preferably less than 20 microns, e.g. 5 to 10 microns in diameter. Thus, when such powder is rapidly launch from a launch system 100 a cloud of finely powdered substance 124 is produced that has a depth of at least about 6 feet, and a width of at least 2 feet and preferably at least 3 feet in diameter. This cloud advantageously "wafts" in the air for several seconds, for example, more than 5 seconds and with some powder loads 124 more than 10 seconds before settling, allowing sufficient time for a target to inhale the powdered substance, and maintain a suspended powder barrier allowing a user to escape. Further, the amount of inhibiting substance and/or portion of inhibiting powder within the powder load 124 can vary depending on many factors. For example, the powder load 124 can contain about 5% PAVA (Capsaicin TI, nonivamide) capsacinoids by weight, with about 95% by weight of inert substances, such as barium sulfate and/or weighting substance(s).

Still referring to FIG. 1, the frame 110 and/or barrel assembly 112 can be constructed of substantially any material or combinations of materials that withstand the impulse and propulsion pressures induced by the activation of the launch system 100. For example, the frame 110 and/or barrel assembly 112 can be fabricated from any number of materials such as, but not limited to, plastic, metal, metal alloys and/or other such similar materials or combinations of materials. In some implementations, one or more components of the frame 110 and/or barrel assembly 112 are formed from molded metal and/or plastic, such as injection molded plastic and/or reinforced plastic (e.g., reinforced with metal, fiberglass or other reinforcement materials). Additionally in some embodiments, the barrel 118 may be opaque or partially opaque so that a user can verify that the powder load 124 has not been launched.

Further, as introduced above, the frame 110 and barrel assembly 112 can be constructed to be detachable. This allows, in some embodiments, the barrel assembly 112 to be pre-loaded with the pusher 126, powder load 124 and seal 128. Similarly, the launch system 110 can be constructed such that the barrel is a replaceable and/or disposable portion that is readily removed from the frame 110 allowing subsequent and/or alternative barrels 112 loaded with powder loads 124 to be easily, and typically, rapidly attached replacing a barrel from which the powder load 124 had been launched, to replace a barrel that may have a defect, to replace a barrel having a first type of powder load with a barrel having a different type of powder load, and other such applications. The barrel 118 can be substantially any size that is capable of providing the rapid expulsion of the loose powder load 124 while maintaining sufficient pressure within the barrel to provide the desired propulsion force to launch the loose powder load at sufficient velocity to induce the powder cloud. For example, in some instances, the barrel has a length that is less than 3 inches, and in some embodiments less than 2 inches greater than a length of the pusher 126, powder load 124 and seal 128 (e.g., in some embodiments, the length of the barrel 118 is less than 3 inches); and with a diameter that is between about 0.25 inches to 2.0 inches, for example about 0.7 inches.

As described above, powder loads of the present embodiments, such as powder load 124, can be launched using any number of different types of impulse energy sources. Again, the impulse energy source can be, for example, from a launch system using the pressure impulse from a conventional firearm primer; an electrically fired primer; a burning gas generator common to automobile airbag technology; known gunpowder technology; by spark ignition of propane, butane or other hydrocarbons; sources of compressed gas such canisters or cartridges of compressed gas (e.g., such as found in refillable paintball gas cylinders); replaceable compressed gas cartridges (e.g., cartridges such as used in air pistols and inflation devices); and other such sources of impulse pressure and/or combinations of sources of impulse pressure.

In actuating the launch system 100, an actuator, such as a trigger button, lever, trigger or other such actuator, activated to release a spring mechanism, move a drive mechanism, actuate a valve, move a levered wedge mechanism or other such method to release the impulse pressure. In some embodiments that utilize compressed gas as at least a portion of the impulse pressure, the actuator causes a compressed gas cartridge to be forces into contact with a puncture pin; a valve to be opened; or uses other release to affect a release of the compressed gas to be directed into the barrel 118 and propel the powder load 124 from the barrel 118 (or shell cartridge containing the powder loads in some alternative embodiments). The expanding gases released into the barrel 118 launch the powder load 124 (or one or more various powder loads described below) towards the intended target. Alternatively or additionally, in those embodiments that utilize a primer, gunpowder and/or chemical gas generator as the source of impulse pressure 114, then the actuator causes an ignition of the primer, gunpowder, chemical gas generator, etc., which produces hot gases that cause an impulse of expanding gas to propel the powder load 124 from the barrel 118 (or cartridge shell).

Figure 2:
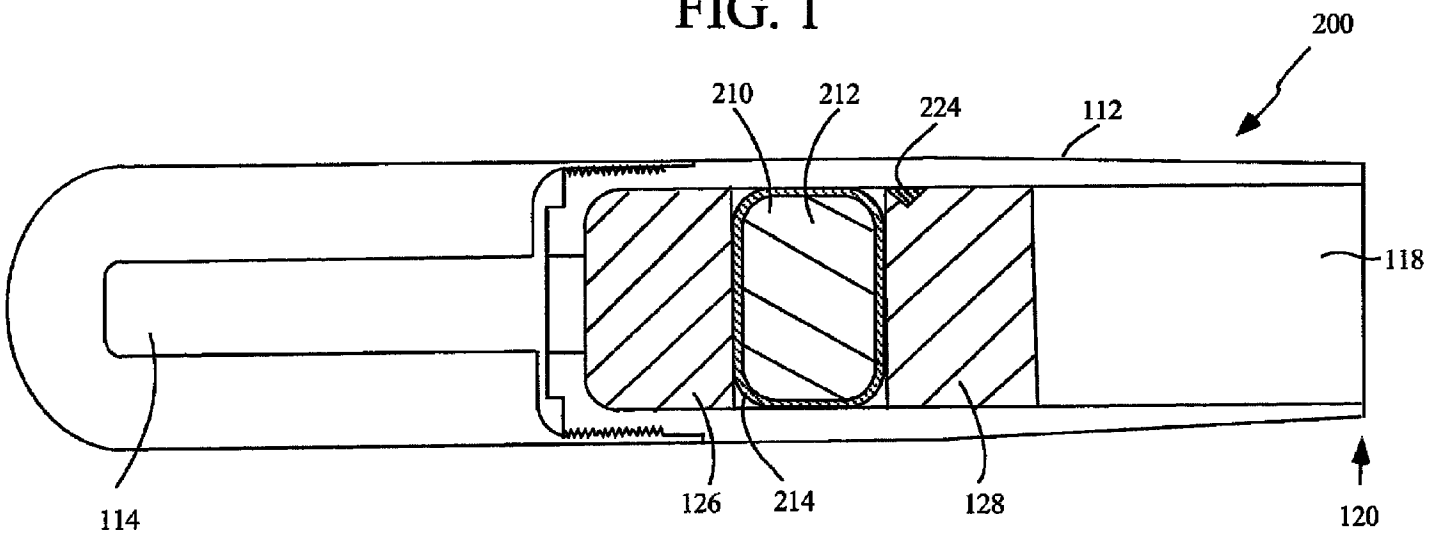
FIG. 2 shows a simplified cross-sectional view of a launch system, similar to that of FIG. 1, with a membrane powder load comprising powder retained within a membrane.

FIG. 2 shows a simplified cross-sectional view of a launch system 200, similar to that of FIG. 1, with a membrane powder load 210 comprising powder 212 retained within a membrane 214. As introduced above, in some implementations the powder load 212 is retained within a membrane or film prior to activation of the launch system 100. The membrane 214 is typically relatively thin and easily ruptured, and can be constructed of substantially any relevant material or combinations of materials such as, but not limited to, plastic, plastic wrap, paper, wax paper, foam, wax and/or other such similar materials or combinations of materials. Typically, the force applied by the pusher 126, in response to the impulse pressure, against the membrane powder load 210 (as well as the force of the membrane powder load 210 against the seal 128) readily breaks the membrane 214 and the loose powder 212 is released from the membrane such that the loose powder 212 is in contact with the interior surface of the barrel 118 for a least a portion of the length of the barrel 118 as the loose powder 212 travels along the barrel 118 toward the exit end 120 of the barrel assembly 112 to be ejected from the barrel assembly 112 in a loose, and in some instances an aerosol state. The broken membrane is relatively light and typically has very poor aerodynamics (particularly after being ruptured within the barrel 118), and as such rapidly falls to the ground and typically does not strike the intended target.

Some embodiments include one or more tabs 224, knife edges, pins or the like positioned within the barrel 118 or at the exit end 120 of the barrel assembly 112. The one or more tabs 224 cut, snag or otherwise rupture the membrane as the membrane powder load 210 is propelled along the barrel 118. In some instance multiple tabs provide multiple cuts and/or effectively shred or partially shred the membrane 214. Additionally or alternatively, a bar or cross-bar structure (not shown) can be fixed within the barrel 118 or at the exit end 120 of the barrel to rupture the membrane 214. Still further, in some instances the membrane may be glued to the interior of the barrel, the interrior or a portion of the interior of the barrel may rough or other such mechanisms can be used to rupture the membrane.

The barrel 118 of the launch system 200 depicted in FIG. 2 is shown with a length that is longer than the barrel of the launch system 100 of FIG. 1. It is noted that the length of the barrel assembly 112 and/or bore 118 can vary depending on payload weight, desired dispersion effect, amount of propulsion forces, launch distance and other such factors. The length of the barrel does not significantly alter the dispersion of the powder load 124 in generating a powder cloud, for at least short or relatively short distances of less than about 15 feet. The longer barrel, however, may simplify assembly of varying powder launch loads and/or embodiments of the launch system as described below.

Figure 3:
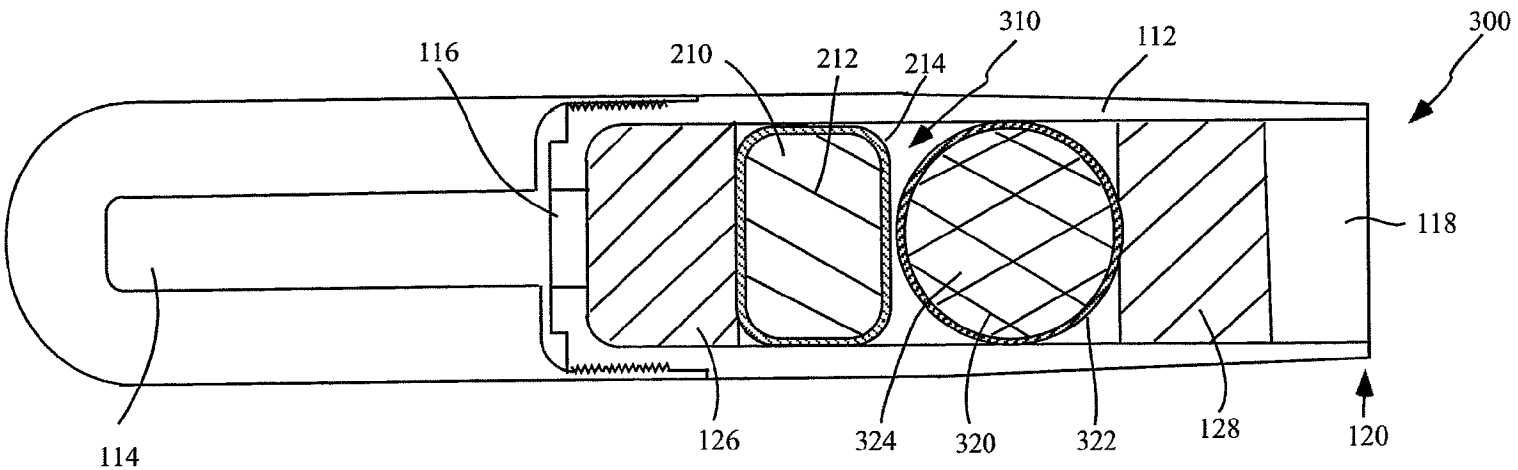
FIG. 3 depicts a simplified cross-sectional view of the launch system, similar to the launch systems of FIGS. 1-2, with a powder load, according to some embodiments, comprising the membrane powder load, comprising powder retained within a membrane, and a projectile.

FIG. 3 depicts a simplified cross-sectional view of the launch system 300, similar to the launch systems 100, 200 of FIGS. 1-2, with a powder load 310, according to some embodiments, comprising the membrane powder load 210, comprising powder 212 retained within a membrane 214, and a projectile 320. In the embodiment shown in FIG. 3, the powder load 310 is retained between a pusher 126 and a seal 128. In some embodiments, the seal 128 is not included and instead the projectile 320 provides a seal or at least a sufficient seal to launch the payloads. Additionally or alternatively, an O-ring (not shown) or other similar structure can be incorporated into the barrel 118 to retain the projectile 320 within the barrel assembly 112 and/or to establish at least a sufficient environmental seal between the O-ring and the projectile 320.

The projectile 320 includes a frangible shell 322 and a payload 324. The payload 324 can include a powdered payload that can be that same as, similar to or different from the powder load 124 and/or powder 212. In other embodiments, the payload 324 is a liquid payload and/or a combination of liquid and powder. The projectile 320 and/or payload 324 can be the same or similar to one or more of the projectiles and/or payloads described in U.S. Pat. Nos. 7,194,960; 6,546,874; 6,393,992; and 5,965,839, and Patent Application Publication Nos. 2005/0188886; and 2006/0027223, all of which are incorporated herein by reference in their entirety.

Upon activation of the actuator of the launch system 300, the source of impulse pressure 114 delivers the propulsion force through the entry opening 116 and into the barrel 118 to drive the loose powder 212 and projectile 320 from the launch system 300. Again, the membrane 214 ruptures during launch, typically as a result of the propulsion pressure and/or the force exerted on either side of the membrane powder load 210 by the pusher 126 and projectile 320. As described above with reference to FIG. 2, one or more tabs 224 or other such structures can be incorporated into the barrel 118 or at the exit end 120 to ensure that the membrane 214 breaks prior to leaving the barrel 118.

The amount and/or weight of the powder load 310 can be substantially the same as those described above. For example, the projectile 320 can have a weight of about 3 grams while the membrane powder load 210 can have a weight of about 2-3 grams, while employing a source of impulse pressure 114 that is substantially the same as those for the embodiments depicted in FIGS. 1-2 and described above. It is noted, however, that the amount of propulsion force can vary depending on the size and/or weight of the powder load 310, and in some instances the length of the barrel 118 between the projectile 320 and the exit end 120. In some embodiments, the barrel 112 has a longer length when a projectile 320 is launched from the launch system 300. The longer barrel length allows the projectile 320 to gain sufficient velocity when launched to have a desired launch distance and/or provide a desired kinetic impact at the target (e.g., that results in pain to the target). Further in some implementations, barrel 118 may include rifling that can induce rotation to the projectile 320, which in some implementations enhances stability and/or increases a launch distance.

Figure 4:
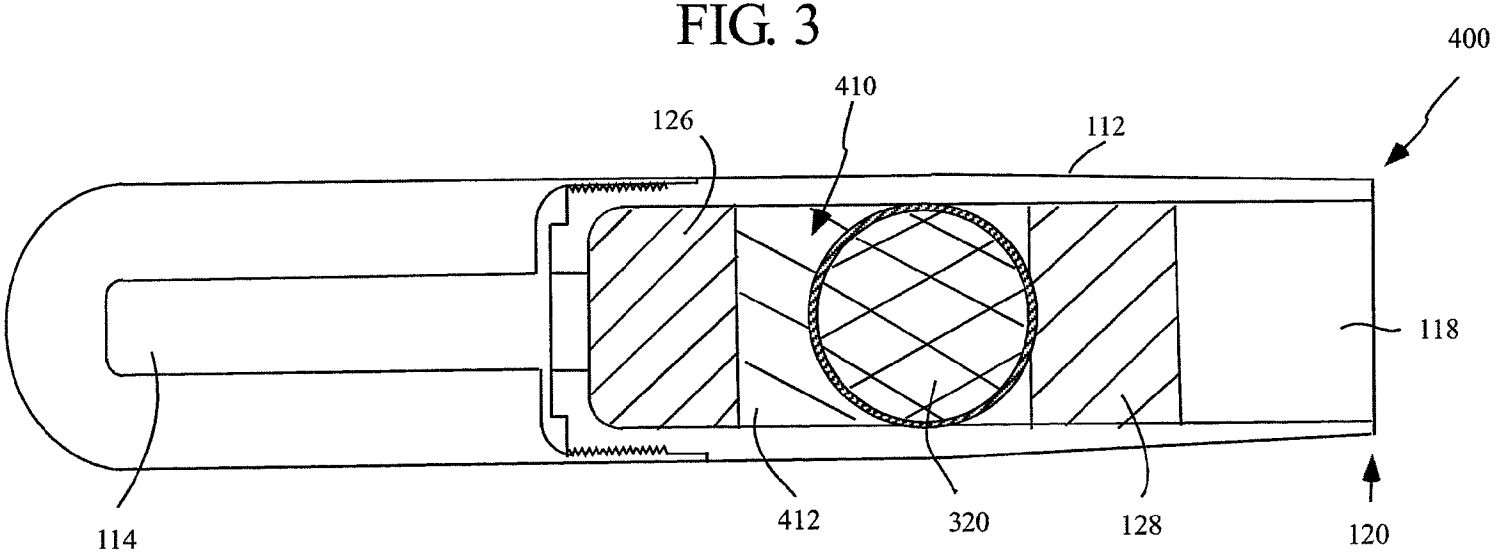
FIG. 4 depicts a simplified cross-sectional view of the launch system, similar to the launch systems of FIGS. 1-2, with a powder load, according to some embodiments, comprising powder and a projectile.

FIG. 4 depicts a simplified cross-sectional view of the launch system 400, similar to the launch systems 100, 200, 300 of FIGS. 1-3, with a powder load 410, according to some embodiments, comprising an unenclosed and free powder 412 and a projectile 320 positioned within the barrel 118. The powder load 410 is retained between a pusher 126 and a seal 128. In some embodiments, the seal 128 is not included and instead the projectile 320 or projectile and sealing structure (e.g., O-ring), provides a seal or at least a sufficient seal to protect the loose powder 412 from the environment. The powder 412 is a loose powder load in that at least a majority of the powder 412 when ejected from the barrel 118 is loose and unenclosed to rapidly disperse into the powder cloud extending from substantially the exit end 120 of the barrel 118 as described above and further below. In some instances the powder 412 can be tapped or lightly compressed while still being launched as loose powder. Upon activation the powder load 410 is propelled from the barrel 118 such that the projectile is launched while the powder 412 is ejected as a loose powder establishing a powder cloud.

The amount and/or weight of the powder load 410 can be substantially the same as those described above. For example, the projectile 320 can have a weight of about 3 grams while the powder load 412 can have a weight of about 2-3 grams, while employing a source of impulse pressure 114 that is substantially the same as those for the embodiments depicted in FIGS. 1-2 and described above. It is noted, however, that the amount of propulsion force can vary depending on the size and/or weight of the powder load 410, and in some instances the length of the barrel 118 between the projectile 320 and the exit end 120. In some embodiments, the barrel 112 has a longer length when a projectile 320 is launched from the launch system 400. The longer barrel length allows the projectile to gain sufficient velocity when launched to have a desired launch distance and/or provide a desired kinetic impact at the target (e.g., that results in pain to the target). Further in some implementations, barrel 118 may include rifling that can induce rotation to the projectile 320, which in some implementations enhances stability and/or increases a launch distance.

Figure 5:
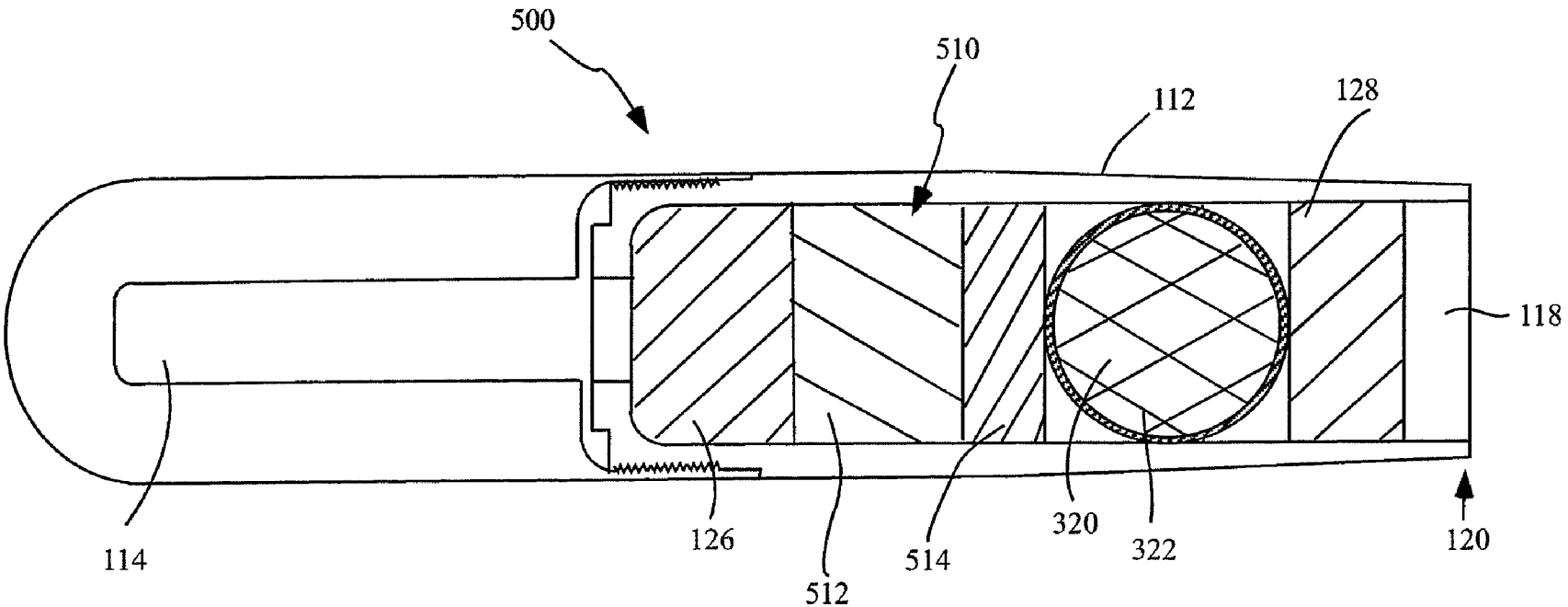
FIG. 5 depicts a simplified cross-sectional view of the launch system, similar to the launch systems of FIGS. 1-2, with a powder load, according to some embodiments, comprising powder and a projectile with a divider or separator positioned between the powder and the projectile.

FIG. 5 depicts a simplified cross-sectional view of the launch system 500, similar to the launch systems 100, 200 of FIGS. 1-2, with a powder load 510, according to some embodiments, comprising powder 512 and a projectile 320 with a divider or separator 514 positioned between the powder 512 and the projectile 320. The powder 512 is unbound and unencased other than by the interior of the barrel 118, the pusher 126 and separator 514, and in some instances can be similar to the powders 124, 412 of FIGS. 1 and 4. The powder 512 is a loose powder load in that at least a majority of the powder 512 when ejected from the barrel 118 is loose and unbounded to rapidly disperse into the powder cloud extending from substantially the exit end 120 of the barrel 118 as described above and further below. The divider 514 retains the powder 512 and substantially prevents the powder 512 from contacting the projectile 320, which may in some instances avoid the powder 512 from being lodged between the shell 322 of the projectile 320 and the interior surface of the barrel 118. In some instances, the lodging of powder 512 between the shell 322 of the projectile and the interior surface of the barrel 118 may jam the projectile within the barrel 118 and/or result in requiring an increased propulsion pressure to launch the powder load 510. The divider 514 can be constructed of substantially any number of materials such as, but not limited to, urethane foam, polymer foam, Styrofoam, paper, cardboard, plastic, rubber, wax, paraffin and/or other such similar materials or combinations of materials. In some implementations, the divider 514 is similar to the pusher 126 and/or seal 128. Further, the divider can create a seal with the interior of the barrel 118 and/or can be glued or otherwise secured with the interior of the barrel.

The powder 512 can be substantially similar to the powder 124 of FIG. 1. The amount and/or weight of the powder 512 can, in some embodiments, be between about 2-3 grams when the projectile 320 has a weight of about 3 grams. The weight of the powder 512 and/or project can vary depending on an amount of propulsion force that can be generated from the source of impulse pressure 114, and/or a desired launch distance of the projectile 320. As described with regard to at least FIG. 3, the length of the barrel assembly 112 can also be increased in some implementations to achieve a desired velocity of the projectile 320 at the exit end 120 of the barrel. Additionally or alternatively, the dimensions of the pusher 126, divider 514 and/or seal 128 can also be adjusted.

Figure 6:
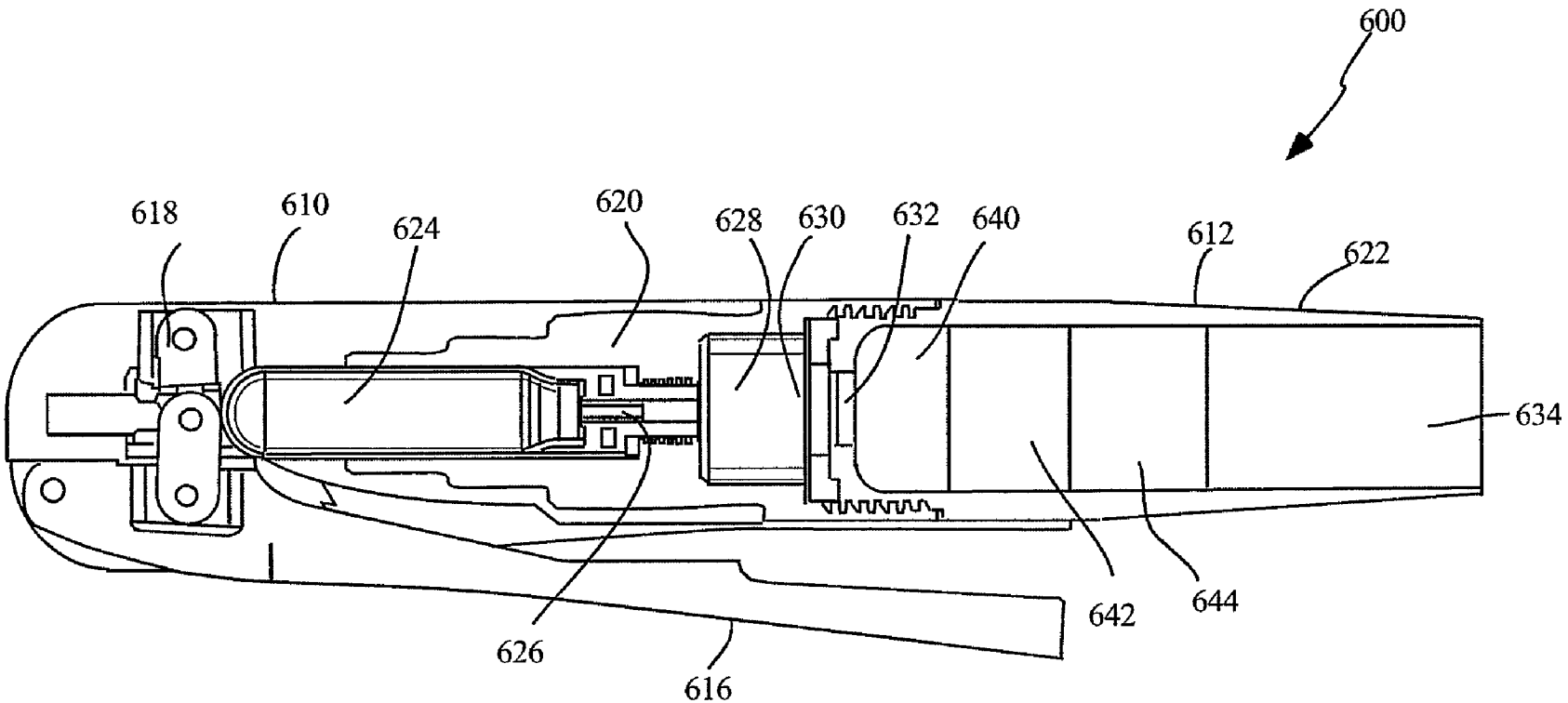
FIG. 6 depicts a simplified cross-sectional view of a launch system according to some embodiments.

FIG. 6 depicts a simplified cross-sectional view of a launch system 600 according to some embodiments. The launch system 600 includes a frame 610 and a barrel assembly 612. The frame 610 includes an actuator or trigger mechanism 616 and a driver 618. The barrel assembly 612 comprises a source of impulse pressure 620 and a barrel 622. Further, the source of impulse pressure 620 includes a compressed gas cartridge, cylinder or the like 624, a puncture pin 626, an expansion chamber 628 and a burst diaphragm or disc 630. The barrel 622 includes an entry opening 632 and a barrel bore 634. A load is incorporated into the barrel bore 634 and the load can include, in some implementations, a pusher 640, powder payload 642 and a seal 644.

In some implementations the barrel assembly 612 is detachable from the frame 610, and further in some embodiments the barrel assembly 612 is replaceable such that upon activation of the launch system 600 and the launching of the powder payload 642, the spent barrel assembly can be detached and a new barrel assembly 612 can be secured with the frame 610. Substantially any mechanism can be employed to secure the barrel assembly 612 with the frame 610. Some of these mechanisms can include, but are not limited to, screw threading, pin and groove, one or more spring loaded pins, latch(es) and other such methods.

Figure 7:
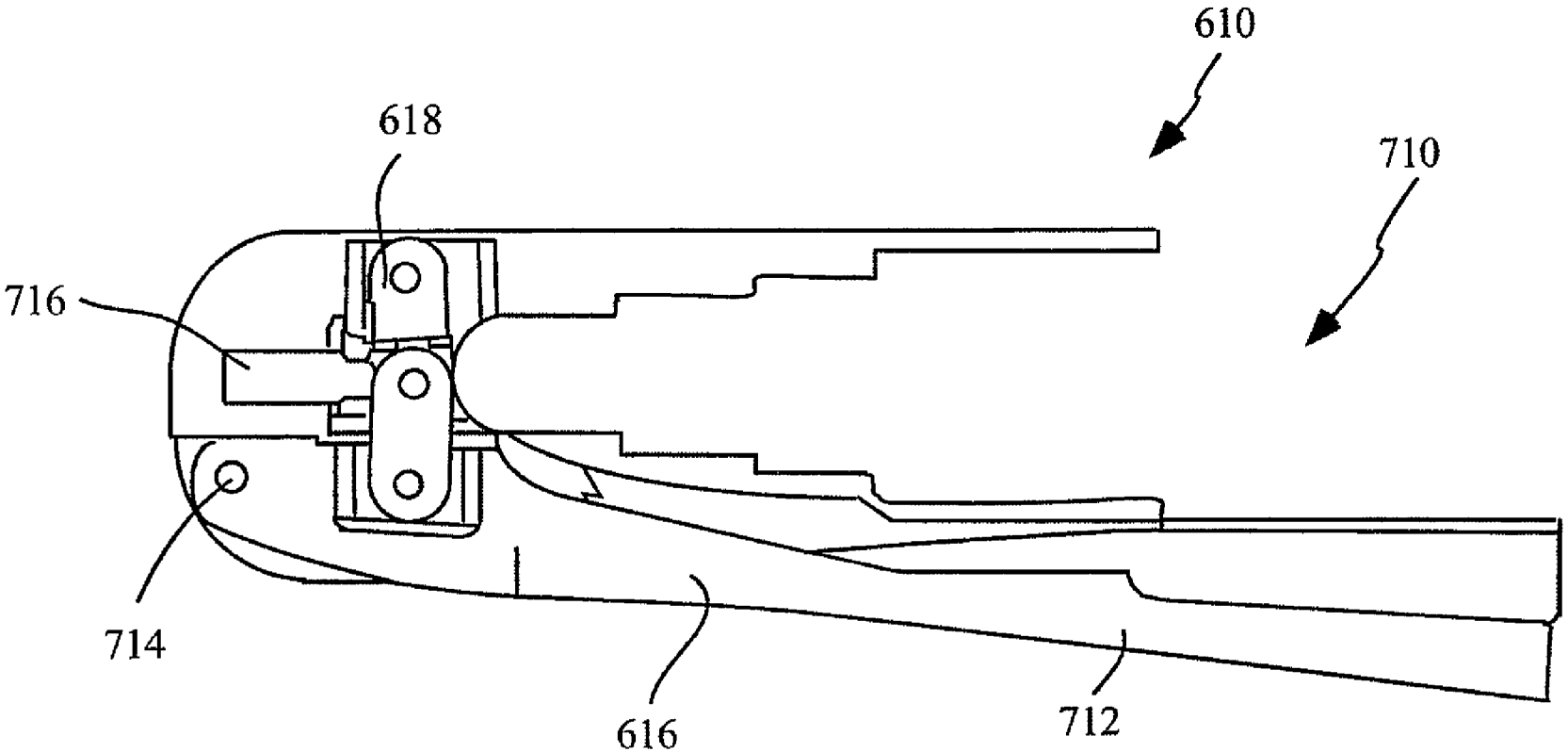
FIG. 7 depicts a simplified cross-sectional view of the frame of the launch system of FIG. 6.

FIG. 7 depicts a simplified cross-sectional view of the frame 610 of the launch system 600 of FIG. 6. The frame 610 as introduced above includes the trigger mechanism 616 and the driver 618. Additionally, the frame 610 includes a barrel assembly receiving port 710 that receives and secures a barrel assembly 612. In some implementations, the trigger mechanism further includes a trigger or actuator lever 712 that is pivotably secured with the frame 610 at a pivot 714, with a rivet, screw, pin or other such mechanism. Further, the lever 712 is in contact with and/or secured with the driver 618. A driver stop 716 is also included in some implementations as described fully below.

Figure 8:
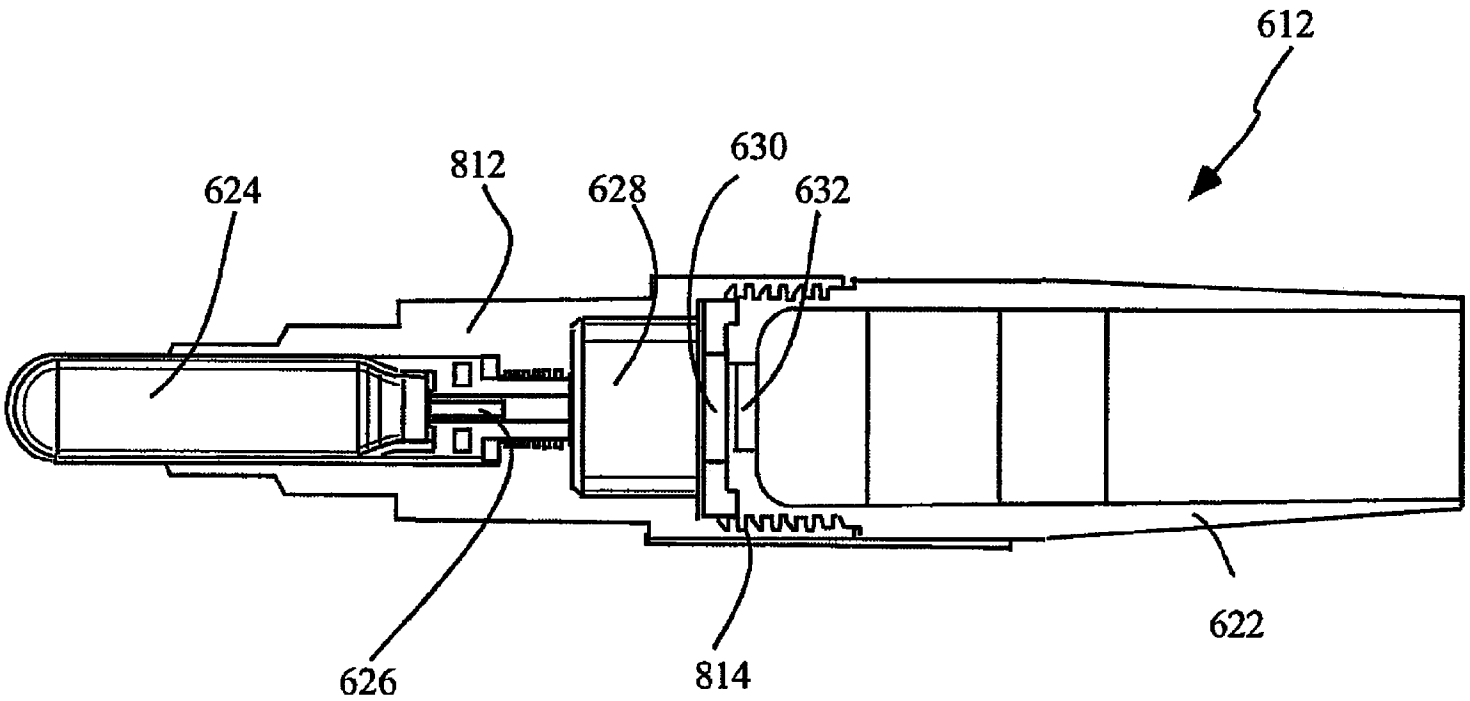
FIG. 8 depicts a simplified cross-sectional view of the barrel assembly of the launch system of FIG. 6, according to some embodiments.
Figure 9:
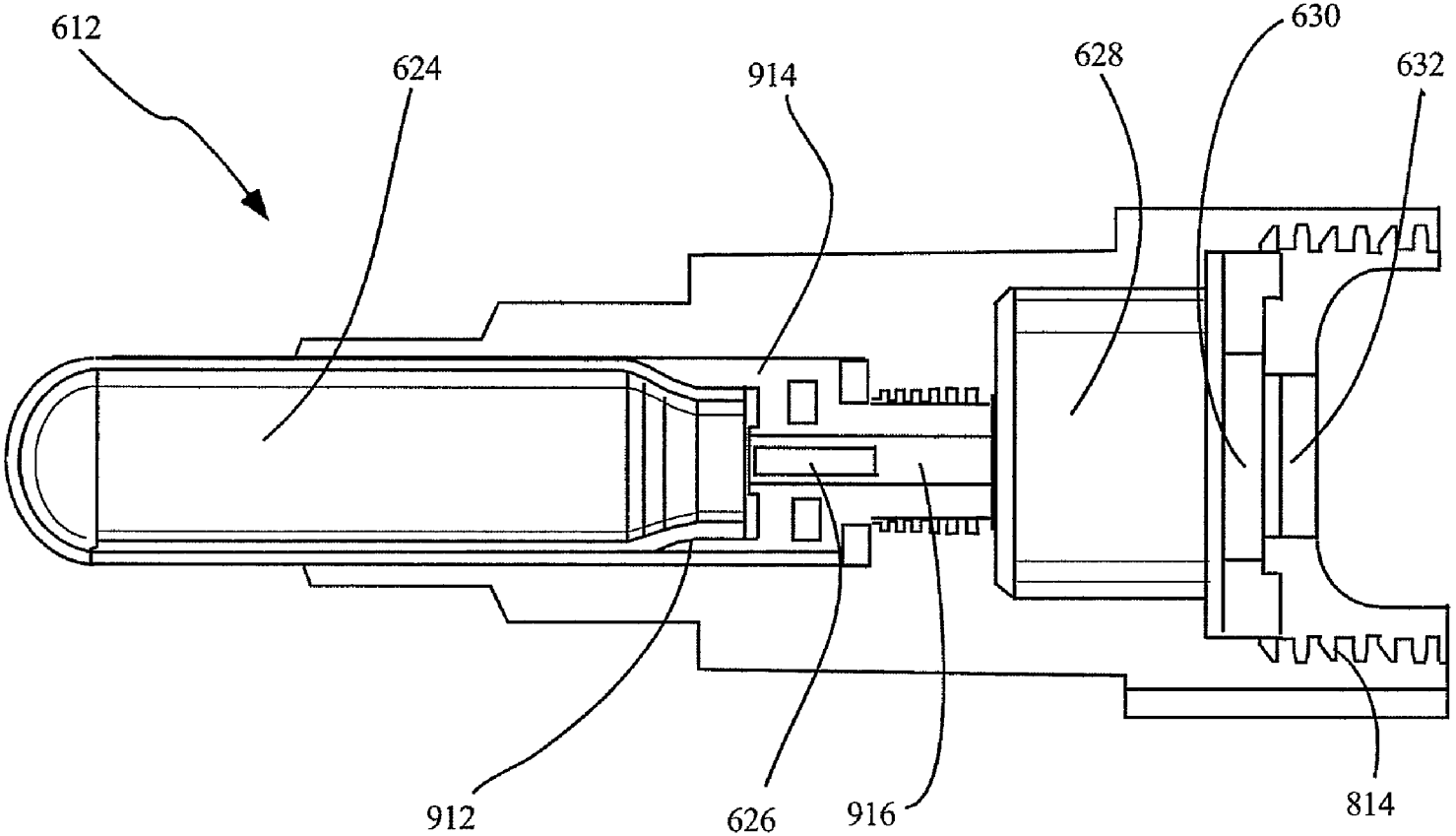
FIG. 9 depicts an enlarged view of a portion of the barrel assembly of FIG. 8.

FIG. 8 depicts a simplified cross-sectional view of the barrel assembly 612, according to some embodiments, that can be utilized in the launch system 600 of FIG. 6. FIG. 9 depicts an enlarged view of a portion of the barrel assembly 612 of FIG. 8 showing the compressed gas cartridge 624, the puncture pin 626, the expansion chamber 628, burst diaphragm 630 and entry opening 632. Referring to FIGS. 6 and 8-9, in some embodiments the barrel assembly 612 is assembled from a cartridge holder or housing 812 and the barrel 622 that are secured together with the burst diaphragm 630 positioned proximate an interface between the cartridge holder 812 and the barrel 622. The cartridge holder 812, in some implementations, is secured with the barrel 622 through threading, gluing, tongue and groove, welding and other relevant methods, or combinations of methods. For example, the cartridge holder 812 can include threading 814 to be screwed together with the barrel 622, and a further adhesive or glue can be included, that in implementations may at least partially melt the material of the cartridge holder and/or barrel to further secure, bond and/or partially weld the components together. Securing the cartridge holder 812 and barrel 622 maintains the relationship between the cartridge holder 812 and the barrel during launching and can withstand the pressures generated in launching the loose powder load 642 and/or a projectile. In some implementations, for example, the cartridge holder 812 and the barrel 622 can be secured by applying glue (e.g., Instant Krazy Glue™) that can be brushed onto threads 814 of one or both the cartridge holder 812 and the barrel 622. In some instances the burst diaphragm 630 is retained in position by clamping the burst diaphragm or a frame or ring positioned with and/or secured with the burst diaphragm between the cartridge holder 812 and the barrel 622. Alternatively, or additionally, the burst diaphragm 630 is also glued or otherwise sealed in place. For example, a glue, such as LOCTITE Superflex Clear RTV™) can be applied on one or both sides of the burst diaphragm (e.g., on both sides of a perimeter of the burst diaphragm 630 to help in preventing leaks). Additionally in some implementations, the barrel assembly 612 is has a cylindrical structure to take advantage of the inherent structural strength to aid in withstanding the launch pressures.

The compressed gas cartridge 624 is slidably positioned within a cartridge port or chamber 912 of the barrel assembly 612 that allows the compressed gas cartridge 624 to slide, when driven by the driver 618, from a first position separated from the puncture pin 626 to a second position in contact with and punctured by the puncture pin 626. In some implementations a cartridge seal 914 is positioned within the cartridge port 912 proximate the puncture pin 626. The compressed gas cartridge 624 transitions from a first position when driven by the driver 618 to a second position to be punctured by the puncture pin 626. Typically, the compressed gas cartridge 624 is further in contact with the cartridge seal 914 that establishes a seal relative to the compressed gas cartridge and the puncture pin such that substantially all of the released gas is directed into the expansion chamber 628, either through and/or around the puncture pin 626. The cartridge seal 914 can be configured from substantially any relevant mechanism, such as an O-ring, washer or other such mechanism, and similarly can be constructed of substantially any relevant material to establish the desired seal. In some implementations, the cartridge seal 914 is part of a puncture pin assembly that further contains the puncture pin 626 and allows the puncture pin to be secured within the barrel assembly 612 relative to the cartridge seal 912. It is noted that the launch system 600 is shown such that the driver 618 drives the compressed gas cartridge 624 onto the puncture pin 626. In other embodiments, however, the puncture pin 626 can be driven into the compressed gas cartridge 624 to puncture the cartridge and release the gas, or both can be driven toward the other.

A passage, conduit or other such tube 916 can be included in some implementations that extends between the puncture pin 626 and the expansion chamber 628 to carry the gas released from the compressed gas cartridge 624 into the expansion chamber 628. The released gas from the compressed gas cartridge can flow through and/or around the puncture pin 626 and into the expansion chamber.

The burst diaphragm 630 seals the expansion chamber 628 from the entry opening 632 and the barrel bore 634. As compressed gas continues to be released from the compressed gas cartridge 624, pressure builds within the expansion chamber 628 and against the burst diaphragm 630. When the pressure within the expansion chamber 628 exceeds a burst threshold of the burst diaphragm, the burst diaphragm bursts or ruptures rapidly releasing the gas from the expansion chamber 628, through the entry opening 632 and into the barrel bore 634. The cross-sectional areas of the burst diagraph 630 and entry opening 632 are relatively large compared with the size of the puncture hole in the cartridge resulting from being punctured by the puncture pin. Further, the burst opening that results within the burst diaphragm as a result of bursting is also relatively large compared to the puncture hole, and in some instances is about the size of the entry opening 116 (e.g., in those instances where the burst diaphragm ruptures into the entry opening 116). In some implementations, the area of the burst opening and/or entry opening 116 is 5, 10 or more times the size of the puncture hole. Because of the relatively large size of the burst opening through which the compressed gas is released into the barrel bore 634, a relatively large amount of compressed gas is rapidly released into the barrel bore 634 to provide a greater propulsion pressure onto the pusher 640 and powder load 642 than otherwise would be provided from the puncture hole alone. The rapidly explosive rupturing of the burst diaphragm provides the relatively large opening to effect the rapid release of the propulsion force. The launch system can be configured such that a size of a resulting burst opening is established or tuned depending desired cloud dimensions, a load weight, burst diaphragm material and/or thickness, an amount of propulsion pressure, an expected amount of impulse pressure and/or other such factors. Additionally, in some implementations the rupture of the burst diaphragm results in an audible noise, report, retort and typically a relatively loud pop or bang (typically that can be heard by a human at more than 15 feet away, generally at more than 20 feet away and in some instances more than 30 feet away), that can startle a target, may notify others individuals in the area of the threat, and in some instance induces a reaction by the target, such as taking an involuntary breath that can cause the target to breath in some of the inhibiting powder of the powder cloud 1210.

The size and/or volume of the expansion chamber 628 typically depends on the compressed gas stored within the compressed gas cartridge 624, the volume of the compressed gas cartridge 624, a burst threshold of the burst diaphragm or a combination of one or more of these. For example, when the compressed gas cartridge 624 stores liquid carbon dioxide ($CO_2$), the volume of the expansion chamber 628 is typically configured to be equal to or larger than the volume of the compressed gas cartridge 624. This is due, at least, to the fact that as the carbon dioxide bottled in liquid form is released there is a phase transition as the liquid transitions and expands into a gaseous state. In some implementations, the volume of the expansion chamber 628 is greater that twice the volume of the compressed gas cartridge 624. For example in some embodiments, the volume of the compressed gas cartridge is about 0.1 cubic inches, while the volume of expansion chamber 628 is about 0.5 cubic inches, providing about a 5-to-1 amplification of the volume with the use of the expansion chamber 628 in cooperation with the burst diaphragm 630. As another example, the volume of the expansion chamber 628 can be about 0.09 cubic inches, which can comprise two connected cylinders, one that is about 0.382 inch in diameter and about 0.417 inches long, and the other that is about 0.627 inch in diameter and about 0.133 inches long. Other sources of compressed gas and/or types of gas can be utilized as introduced above, such as air, nitrogen, other relevant gases or combinations of gases. The expansion chamber 628 and/or burst diaphragm 630 can be configured, selected and/or otherwise tuned to one or more desired performance characteristics, such as but not limited to desired cloud dimensions, a powder load weight, an amount of propulsion pressure, an expected amount of impulse pressure, burst diaphragm material and/or thickness, and/or other such factors.

The burst diaphragm 630 can be constructed of substantially any relevant material capable of withstanding the desired pressures and rupturing at about a desired pressure threshold. Further, the burst diaphragm 630, in some embodiments, is a replaceable, disposable rupture disk membrane secured between the barrel bore 634 and the expansion chamber 628. When the gas pressure in the expansion chamber volume reaches the stress limits of the membrane material of the burst diaphragm, the burst diaphragm ruptures and the expanded gas is released to accelerate the powder load 642 (and/or one or more projectiles) out of barrel bore 634. The burst diaphragm 630 can be constructed of Mylar™, polyethylene terephthalate (PET) Polyester film, paper, plastics, metal, and substantially any other relevant material that maintains the expanding gas within the expansion chamber allowing gas pressure to build until a predefined and/or desired pressure is attained at which point the burst disk ruptures. For example, in some implementations the burst diaphragm 630 can be made of Mylar™ with a thickness of more than 1.5 mm, for example, 3 mm, or other such thickness to provide a burst threshold at a desired level, and/or include structural weakening features.

The burst diaphragm 630 may rupture by exceeding the stress limit of the material, alternatively by coming in contact with a sharp device within the barrel assembly 612 that causes the burst diaphragm to puncture releasing the built-up gas, and/or by breaking a seal or other means of rupturing the burst diaphragm. The burst diaphragm 630, in some implementations, is scored to control or change the pressure at which the burst diaphragm bursts. The scoring can be in substantially any configuration to establish weakening points that allow, in some implementations, more precise and consistent bursting at desired pressure thresholds. Additionally and/or alternatively, the burst diaphragm 630 under pressure may be designed to burst using other methods such as: mechanical cutting or piercing of the burst diaphragm; using heated coils or electrical arcs to create or melt a weak section or an initial pin or small hole in the burst diaphragm; or other methods of aiding rupturing the diaphragm material. Typically, the burst diaphragms have consistent burst thresholds providing consistent operation of the launch system 600 between launches (e.g., by replacing a spent barrel assembly 612 with a new, loaded barrel assembly). Other embodiments of the launch system 600 may employ one or more of a mechanical valve that opens; a fixed diaphragm that opens by moving, folding and the like without rupture (e.g., using magnets that release at defined pressures); a friction held or other types of gas plug; and/or other relevant types of gas retainer design methods that can be made to move or open to allow gas flow. The burst diaphragm 630, valve and/or gas plug at least in part allows sufficient gas pressure and volume to buildup, and once the burst diaphragm ruptures (or is otherwise released) the gas enters the barrel bore 634 providing a propulsion force on the pusher 640 to propel the powder load 642 from the barrel bore 634 creating the desired powder cloud.

Referring back to FIGS. 6-7, the driver 618 can be substantially any mechanism that responds to the actuation lever 712 to drive the compressed gas cartridge 624 onto the puncture pin 626, or that drives the puncture pin into the compressed gas cartridge. In some implementations, the driver 618 transfers the motion of the actuation lever 712 to the compressed gas cartridge 624 or puncture pin 626. For example, as the lever 712 is actuated by an external force (represented by the arrow labeled 720) the lever pivots at the pivot 714 and activates the driver 618 to move the compressed gas cartridge 624 to be punctured by the puncture pin 626. In some embodiments, the frame 610 further includes a driver stop 716. The driver stop is cooperated with the driver 618 to maintain a positioning of the driver 618, at least prior to activation.

Figure 10:
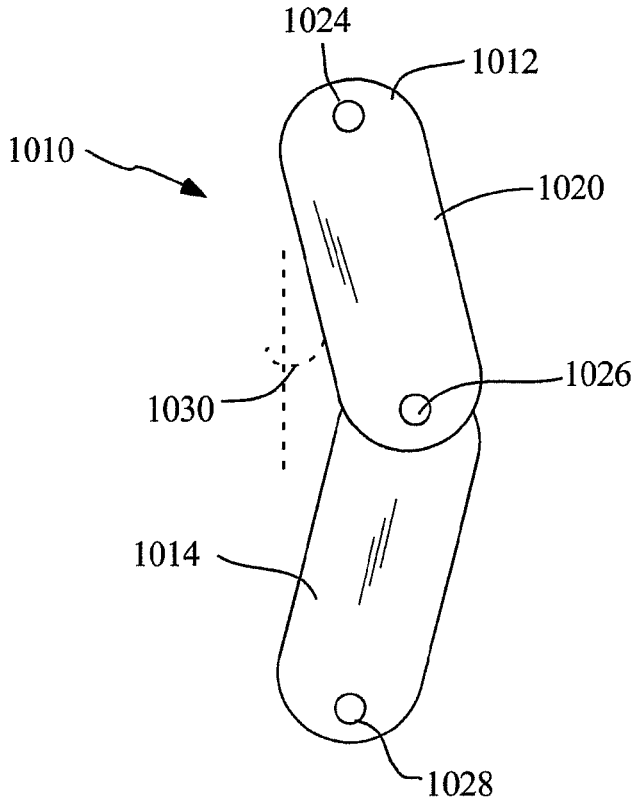
FIG. 10 show a simplified front view of a driver that can be employed within the launch system depicted in FIGS. 6-7.
Figure 11:
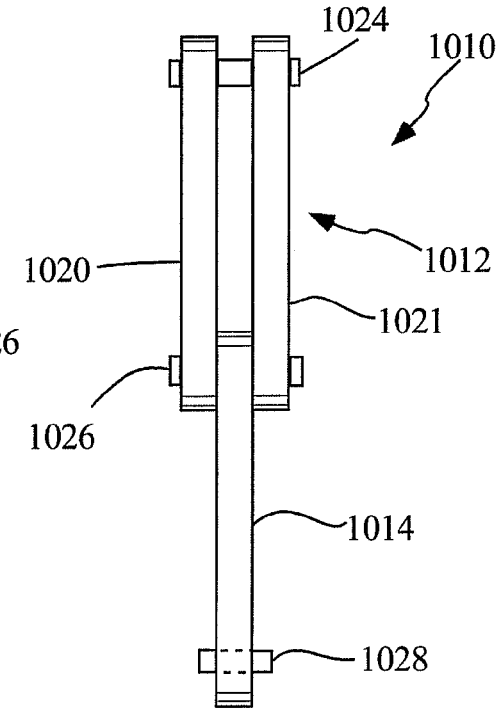
FIG. 11 show a simplified side view of the driver of FIG. 10 that can be employed within the launch system depicted in FIGS. 6-7.

FIGS. 10-11 show a simplified front view and a side view, respectively, of a driver 1010 that can be employed for the driver 618 of the launch system 600 of FIGS. 6-7. The driver 1010 includes a fixed fulcrum arm pair 1012 and a lever fulcrum arm 1014. As shown in FIG. 11, the fixed fulcrum arm pair 1012 can include two fulcrum arms 1020-1021 that are positioned on either side of the lever fulcrum arm 1014. It will be apparent to those skilled in the art that other configurations can be utilized. For example, the fixed fulcrum arm pair 1012 or lever fulcrum arm 1014 can be replaced by a single, generally Y-shaped fulcrum arm. The fixed fulcrum arm pair 1012 is secured with the frame 610 at a first pivot 1024, and pivots relative to the frame 610 at the pivot 1024. Further, the fixed fulcrum arm pair 1012 is secured with the lever fulcrum arm 1014 at a second pivot 1026. Similarly, the lever fulcrum arm 1014 is pivotably secured with the actuator lever 712 at a third pivot 1028.

Upon activation of the actuation lever 712, the lever fulcrum arm 1014 is moved toward the fixed fulcrum arm pair 1012. As the lever fulcrum arm 1014 is moved toward the fixed fulcrum arm pair 1012 both the lever fulcrum arm 1014 and the fixed fulcrum arm pair 1012 move, at the second pivot 1026, generally laterally and/or perpendicular to the force applied by the lever fulcrum arm at pivot 1028. This lateral movement of the lever fulcrum arm 1014 and the fixed fulcrum arm pair 1012 results in a relatively large lateral movement for a relatively small vertical motion.

As introduced above, some embodiments include a driver stop 716. The driver stop 716 can maintain a positioning of the lever fulcrum arm 1014 relative to the fixed fulcrum arm pair 1012. Particularly, the driver stop 716 prevents the lever fulcrum arm 1014 from being aligned with the fixed fulcrum arm pair 1012, and maintains an angle 1030 between the lever fulcrum arm 1014 and the fixed fulcrum arm pair 1012. This angle 1030 ensures that the driver 618 will bend at the second pivot 1026 and induce the lateral motion to drive the compressed gas cartridge 624 onto the puncture pin 626 (or the puncture pin into the compressed gas cartridge). In some implementations, the actuation lever 712 in cooperation with the driver 618 can induce 40 lbs or more of pressure that can be exerted on the compressed gas cartridge 624 to puncture the cartridge.

Figure 12:
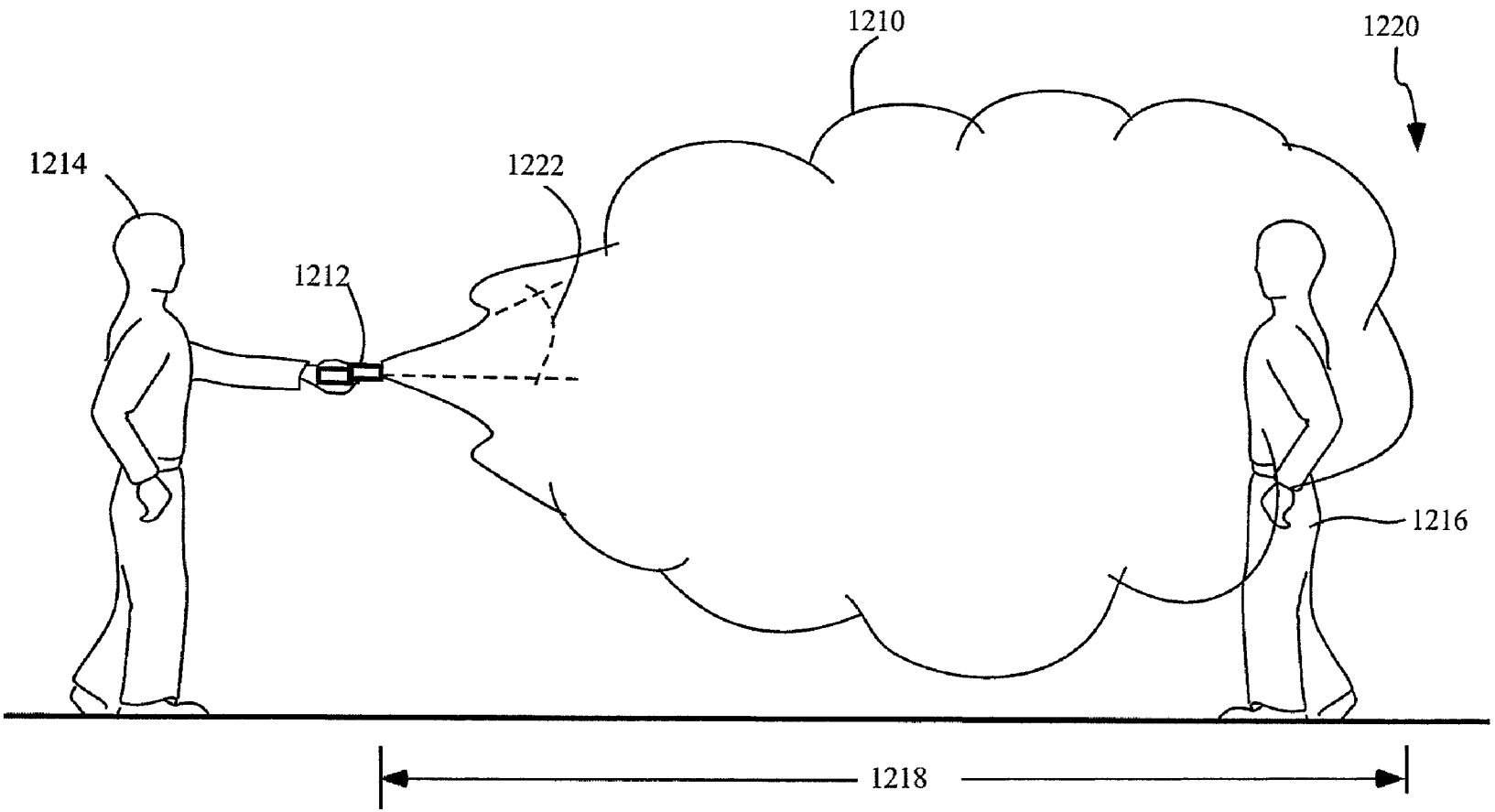
FIG. 12 depicts a simplified block diagram representation of a powder cloud generated following the activation of a launch system directed at a target.

As described above, the launch systems 100, 600 rapidly launch loose powder, e.g., loose powder 124 (and in some instances a projectile, e.g., projectile 320) generating a powder cloud. FIG. 12 depicts a simplified block diagram representation of a powder cloud 1210 generated following the activation, by a user 1214, of a launch system 1212 (which can be similar, for example, to the launch systems 100, 600 of FIGS. 1-9) directed at a target 1216. The use of the expansion chamber 628 and the burst diaphragm 630 allows the launch system 1212 to rapidly apply the propulsion pressure to the pusher 126, 640. As described above, the burst diaphragm 630 fails at a burst threshold providing a relatively large hole through which the compress gas rapidly, and in some instances substantially instantaneously exits. The built up pressure within the expansion chamber 628 can be substantially any relevant pressure to achieve the desired propulsion pressure. In some implementations, burst threshold can be 600 psi or more. For example, when using compressed gas cartridge 624 holding compressed carbon dioxide at about 800 psi, the burst diaphragm 630 can be selected to have a rupture threshold of less than 800 psi, and the expansion chamber can be configured with a volume that allows the compressed carbon dioxide to be released from the compressed gas cartridge 624, phase transition to the gaseous state, and generate a sufficient pressure within the expansion chamber 628 and against the burst diaphragm 630 to rupture the burst diaphragm providing a rapid release of the gas to drive the pusher 640 to propel substantially all, and preferably, the entire power load 642 from the barrel 622. As a result, the loose powder 642 is launched from the barrel 622 in less than one second, typically less than one half a second, and more typically in less than hundreds of milliseconds from the time the compressed gas cartridge 624 is punctured.

Further, the propulsion pressure when released from the expansion chamber 628 is sufficient to launch the loose powder load 642 at a sufficient velocity to generate the cloud 1210 of powder (which in some embodiments as described above, include inhibiting powder) establishing a barrier between the user 1214 and the target 1216. Further, the rapid launch of the loose powder load 642 results in the rapid dispersion of the powder cloud 1210 that has a depth 1218, measured from a exit end of the barrel at the time of launch and an advancing front end 1220 of the cloud, within less than a second, typically less than one half a second, and some implementations within less than tens of milliseconds from the time the compressed gas cartridge 624 is punctured. For example, some embodiments establish an propulsion pressure of between about 600 and 800 psi resulting in a rupture of the burst diaphragm 630 and propel the loose powder 642 from the launcher 610 at a velocity of greater than 100 feet per second, typically greater than 200 feet per second, and in some instance at about 300 feet per second or more, to produce a powder cloud 1210 that has a depth 1218 (measured generally parallel with the length of the barrel 622 at the time of launch) of more than 5 feet, and typically more than 8 feet, and in some instances as much as 14 feet or more, in less than one half a second from the time the compressed gas cartridge 624 is punctured; additionally, the loose powder 642 exits the exit end 120 of the barrel 622 at an angle 1222 relative to an axis of the barrel length that is generally greater than about 10 degrees, and in some instances greater than 20 degrees such that a width of the powder cloud 1210 is greater than about 2 feet, and typically greater than about 3 feet when measured at a depth 1220 of at least 8 feet. The launch system can be configured and/or tuned to achieve a desired exit velocity depending on one or combinations of the many variables, such as but not limited to, source gas pressure and volume, expansion chamber and volume, burst disk material and thickness, entry opening and/or burst diaphragm retaining ring hole, barrel length, payload weight and other such factors and/or combinations of factors.

As the powder cloud 1210 advances it envelops the target 1216 in those instances where the target 1216 is within at least the depth range of the powder cloud and/or should the target try to advance toward the user 1214. The inhibiting powder within the powder cloud 1210 rapidly contacts and affects the target 1216 inhibiting and in some instances effectively disabling the target 1216. Further, because the launch systems 100, 600 launch the loose powder load 124, 642 that generates the large powder cloud 1210, that is typically about as large as or larger than an average adult human, the user 1214 is not required to have good aim or directly hit the target 1216 with a projectile and still achieve effective deterrent results. Instead, the powder cloud 1210 establishes a barrier between the user and the target 1216 and in some instances surrounds and/or envelopes the target 1216. This powder cloud 1210 further "wafts" in the air for several seconds, for example, for more than 6 seconds and in some instances as much as 10 seconds or more before settling, allowing sufficient time for the target 1216 to inhale the powdered substance and/or get irritant powder in the target's eyes, as well as allow the user 1214 sufficient time to flee with the barrier of the powder cloud 1210 protecting the user's retreat.

This is in contrast to many non-lethal deterrent systems in that many non-lethal deterrent systems require the user to be directly hit with a projectile or stream of liquid. Further, some deterrent systems, such as canisters of pepper spay, additionally require relatively long periods of time of, in some instances, 10 seconds or more to empty the canister of the inhibiting substance. Still further, many deterrent systems not only require a direct hit of the target but further require the inhibiting substance to be a directed stream into the targets eyes, which can be particularly difficult in stressful situations where an assailant is rapidly approaching and trying to prevent the inhibiting substance from hitting his/her eyes.

The rapidly dispersed powder cloud 1210 does not require a direct hit of a projectile or require that the powder be specifically directed into the target's eyes. Instead, the powder envelops the target 1216 and enters the target's eyes (even passing around glasses), mouth and nasal cavity to inhibit the target 1216. Further, the powder cloud can pass around and/or through barriers to content a target, including passing around obsticles that a target might be hiding behind, passing around glasses and other obsticles, obstructions and/or barriers.

Some embodiments, as described above can additionally include a projectile 320. These embodiments additionally allow the user to launch that projectile 320, which will typically travel a further distance that the powder cloud 1210. Additionally, the impact of the projectile 320 provides a kinetic impact on the target that can result in pain to the target.

The powder loads 124, 624 and/or payload 324 of a projectile 320, as described above, can comprise any of the following substances: an inhibiting substance such as oleoresin capsicum (also referred to as "OC"), capsaicin, nonivamide (i.e., one or more of the hottest active ingredients or capsaicinoids within oleoresin capsicum), tear gas (e.g., CS or CN), PAVA and other such natural and synthetic inhibiting substances; a marking or tagging substance, such as a colored dye, UV dye, IR dye or other such marking substance; a malodorant; and/or an inert substance, such as barium sulfate, baby powder, corn starch, talcum or other such inert substances; weighting substances; and/or any combination thereof. For example, the powder 124, 624 and/or payload 324 in accordance with some embodiments can include a combination of oleoresin capsicum and barium sulfate (or alternatively, a combination of PAVA (nonivamide) and barium sulfate and/or other such inert powders and/or weighting particles), at a desired ratio(s). Alternatively, a combination of PAVA and/or oleoresin capsicum, and/or other inhibiting substance, and a colored dye, malodorant and/or other marking substance, may be employed to simultaneously incapacitate the target and mark the target for later identification. In some embodiments a marking substance, a chemical marker or chemical fingerprinted paint, such as produced by Yellow Jacket, Inc. of California, can be used which effectively leaves a chemical ID or chemical fingerprint on the target, which can be used by the police to verify a person was struck by a non-lethal projectile. As such, the chemical marker can include a chemical ID, identifying the batch of the marker, that is formulated into the marker during manufacture. For example, a fleck of the chemical marker found on a suspect two weeks after being impacted with the chemical marker, can be chemically identified and traced to launch system 100; thus, the suspect may be linked to a crime scene by the chemical marker. In yet other alternatives, it may be desirable to employ only a marking substance or only an inert substance, such as barium sulfate or talcum, as the powder load 124, such as when the launch system 100, 600 is being used for training purposes. Similarly, any projectile 320 can be filled with an inhibiting powder or liquid, inert powder or liquid, and/or could be empty.

In some embodiments, the projectile 320 includes the shell 322, for example, a spherical capsule (although other shapes of projectile bodies may be used) separable into two about equal halves (e.g. a first part and a second part), wherein the halves contain a powdered impairing substance sufficient in amount so that the shell 322 is about or greater than 50% full and preferably between about 60% and 99% full, for example, from between 75% and 95%, for example, about 90% filled with a powdered substance 324 and wherein, to facilitate manufacture of the projectile 320, the powdered substance 324 within each half is compressed into a ball, tablet, mount and placed in one half and sealed with the other half. Alternatively, the powder(s) 324 could be compressed into each separate half and retained therein by a thin membrane, for example a paper foil, which contacts the inhibiting substance during assembly of the projectile 320. In this embodiment, the thin membrane is sufficiently strong to retain the desired substance 324 within the shell 322 as it is manufactured or assembled, yet frangible enough to readily rupture subsequent to sealing of the shell 322 and prior to, or at least simultaneously with, impact with the target.

The powder load 124 and/or payload 324 of the projectile 320 may, for example, contain at least 0.5% inhibiting substances (such as PAVA, nonivamide (from natural or pharmaceutically and/or synthetically produced sources) or oleoresin capsicum), e.g., between 1% and 30%, e.g., between 5% and 20%, with a remainder of the powder load 124 (or payload 324) being either an inert substance or a marking substance or a different inhibiting substance, such as tear gas powder or a powder malodorant. Alternatively, the powder load 124 and/or payload 324 may, for example, comprise at least 0.1% capsaicin (which is an active ingredient within oleoresin capsicum in either natural form or pharmaceutical produced form), and preferably at least 0.5% capsaicin with the remainder of the powder load 124 and/or payload 324 as either a marking substance, an inert substance, and/or a malodorant. Similarly, more than one inhibiting substance may be combined to provide a total of at least 0.1% to about 30% or more of inhibiting substances (e.g., depending on the target to be impacted, such as a higher percentage may be employed for impacting large animals).

In some variations, the powder load 124 and/or payload 324 may include fragments of solid material to enhance dispersion of the loose powder load 124 and/or payload 324. For example, crushed walnut shells, rice, wood shavings, metal particles, such as metal powder or metal particles, or the like may be added to the powder to help carry the powder away from the launch system 100 and/or a point of rupture of the projectile 320 against a target. The solid material, having a greater density and mass than the powder load 124 (e.g., of inhibiting substance, inert substance and/or marking substance) tends to project further from the launch system 100, thereby facilitating dispersion of the loose powder load 124 as it is carried by the solid material.

In further variations, a visible marking agent, a covert UV or IR visible dye, malodorant, or other taggant can be added to the powder load 124 and/or payload 324 of the projectile 320 in order to provide a mechanism for identifying the target at a later time. This feature of this variation may be particularly useful in law enforcement or military applications, where evidence gathering may be enhanced if the target can be marked. By combining a marking agent with an inhibiting substance a significant synergism is achieved. In another aspect, marking can be effected by bruising of the target due to the kinetic impact of the projectile 320 against the target.

In some embodiments of a marking substance, the projectile shell 322, e.g., capsule, may contain a chemical compound that has a particularly offensive odor, also referred to as a malodorant. In use, the projectile 320 can be launched at a suspect, such that the suspect will have an unwelcome odor on his or her person. Such odor will effectively "mark" the person. Additionally, a projectile 320 containing a malodorant as at least part of the payload 324 may be used to repel or keep persons away from a particular area. An area impacted by one or more projectiles 320 will typically smell so offensive that it will keep others from coming near the smell. The malodorant has applications in crowd dispersal and crowd control, as well. On example of a malodorant that has a particularly offensive odor is called "Dragons Breath" which is an organic sulfur compound produced by DeNovo Industries, of The Woodlands, Tex. In variations of this embodiment, a projectile 320 can include as the payload 320, or at least part of the payload, a glass capsule contained within the projectile shell 322. The glass capsule seals within itself certain malodorants, such as Dragons Breath and/or other sulfur compounds, that have solvent properties that can eat through a plastic variety projectile shell. The glass capsule within the projectile body is ruptured upon impact of the projectile body, releasing the malodorant. In further variations, the glass capsule is guided centrally within the projectile with protrusions formed within the projectile. These protrusions center the glass capsule within the projectile capsule and additionally may provide pressure points to assist in the fracturing of the glass capsule upon impact.

In yet a further variation, the payload 324 within the projectile 320 can include a powdered inhibiting substance combined with a liquid or gas irritant, or other agent to be delivered. The liquid or gas, and the powdered irritant can be carried in separate chambers, in for example, separate halves of the projectile 320 using membranes described herein to contain the powdered inhibiting substance and the other agent, keeping them separated, if needed. If a liquid or gas is contained by one or both of the membranes, such membranes can be made, for example out of plastic, vinyl, rubber or the like. The projectile 320 can be similar to those described at least in U.S. Pat. Nos. 7,194,960; 6,546,874; 6,393,992; and 5,965,839, and Patent Application Publication Nos. 2005/0188886, and 2006/0027223, all of which are incorporated herein by reference in their entirety.

Figure 13:
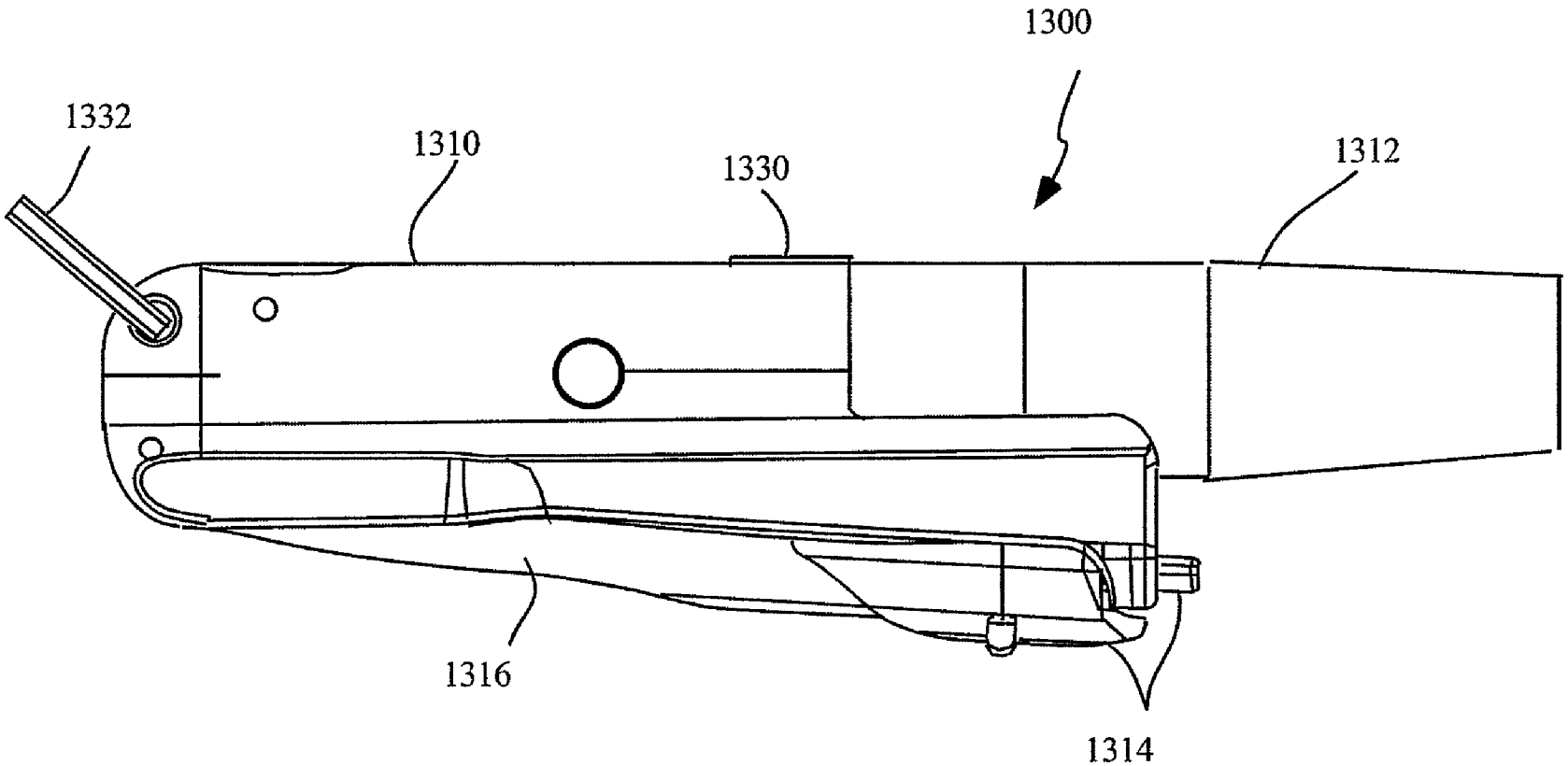
FIGS. 13-14 depict a side view and a cross-sectional view, respectively, of a launch system according to some embodiments
Figure 14:
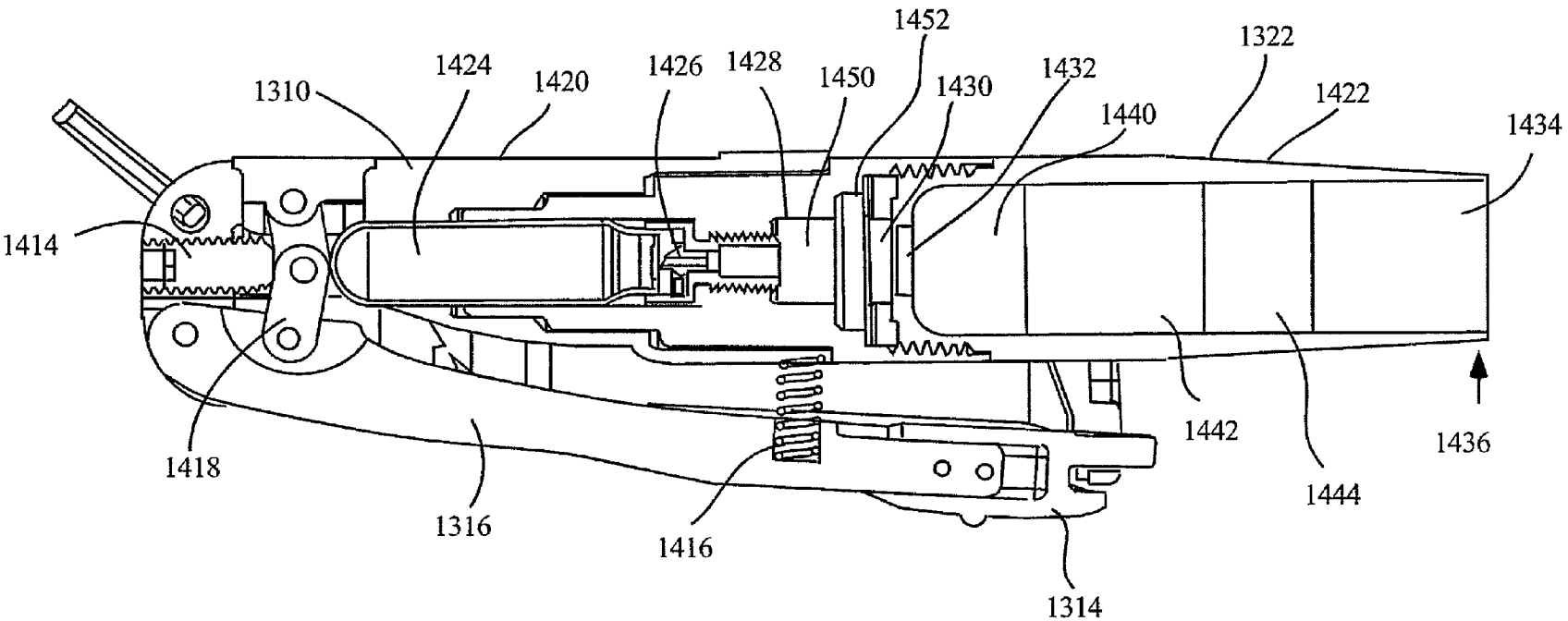
Figure 15:
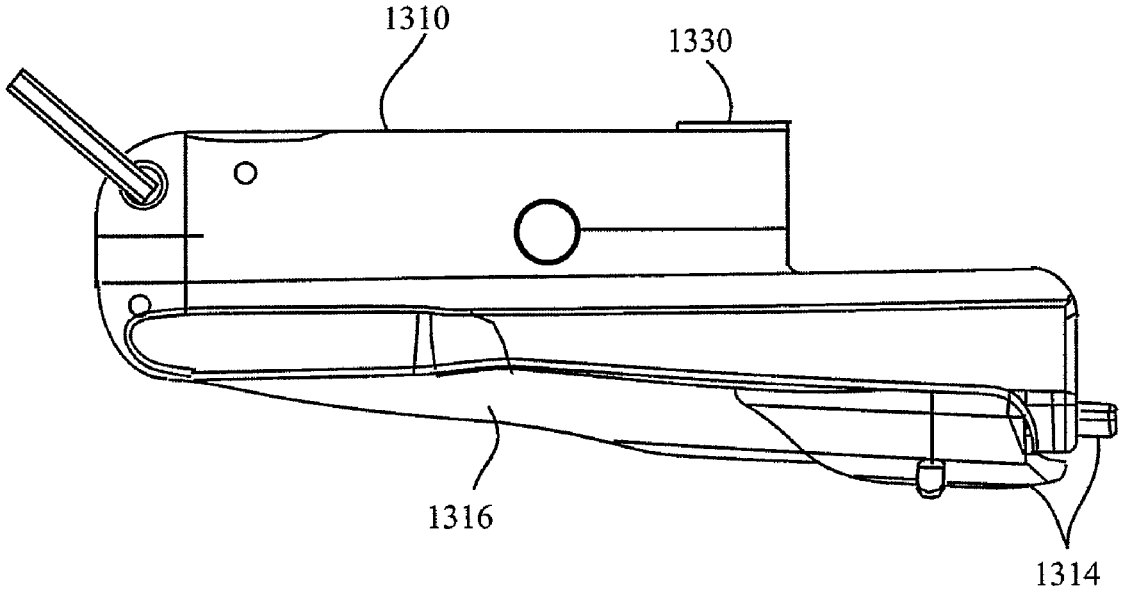
FIG. 15 depicts a side view of a frame of the launch system depicted in FIGS. 13-14.

FIGS. 13 and 14 depict a side view and a cross-sectional view, respectively, of a launch system 1300 according to some embodiments. The launch system 1300 includes a frame 1310 and a barrel assembly 1312. FIG. 15 depicts a side view of the frame 1310 of the launch system 1300 of FIGS. 13-14. Referring to FIGS. 13-15, the launch system 1300 further includes a safety 1314, an actuator or trigger lever 1316, a driver 1418, a driver stop 1414, and an actuator lever biasing member 1416 fixed with the frame 1310. The barrel assembly comprises a source of impulse pressure 1420 and a barrel 1422. Further, the source of impulse pressure 1420 comprises a compressed gas cartridge 1424, a puncture pin 1426, an expansion chamber 1428 and a burst diaphragm 1430. The barrel 622 includes an entry opening 1432 and a barrel bore 1434. A load is incorporated into the barrel bore 1434 and the load can include, in some implementations, a pusher 1440, powder payload 1442 and a seal 1444.

The safety 1314 is slidably secured with the actuator lever 1316 and extends, when in an active state to prevent activation of the launch system 1300, through a hole 1326 of the frame 1310. In operation, a user would slide the safety 1314 in a direction away from the exit end 1436 of the barrel 1434, for example, by press the extended portion of the safety 1314 that extends through the hole 1326 of the frame 1310. The actuator lever 1316 is further cooperated with the lever biasing member 1416 that biases the actuator lever 1316 away from the frame 1310. Upon depression of the actuator lever 1316, the lever biasing member 1416 compresses, the actuator lever 1316 drives the driver 1418 into the compressed gas cartridge 1426 to force the compressed gas cartridge onto the puncture pin 1426. The punctured compressed gas cartridge 1424 releases compressed gas through and/or around the puncture pin 1426 to enter the expansion chamber 1428. In some implementations the expansion chamber 1428 comprises two cooperated sub-chambers (which in some instances are connecting cylinders) 1450, 1452. For example, the volume of the expansion chamber 628 can be about 0.1 cubic inches, where the first cylindrical sub-chamber 1450 can have a diameter that is about 0.4 inch and about 0.42 inches deep, and the second cylindrical sub-chamber 1452 can have a diameter of about 0.63 inch and a depth of about 0.14 inches.

Once the pressure within the expansion chamber exceeds a burst threshold of the burst diaphragm 1430, the propulsion pressure rapidly enters the barrel bore 1434 to drive the pusher 1440 that in turn drives the powder 1442 from the barrel 1422. Some embodiments may further include a site 1330 and/or laser site (not shown, but may be activated, for example upon disengaging the safety 1314) to aid the user in aiming the launch system 1300. Additionally, some embodiments may include a key ring 1332, clip or other fastener on which keys or other devices can be secured and/or that can provide for easy of carrying.

Figure 16:
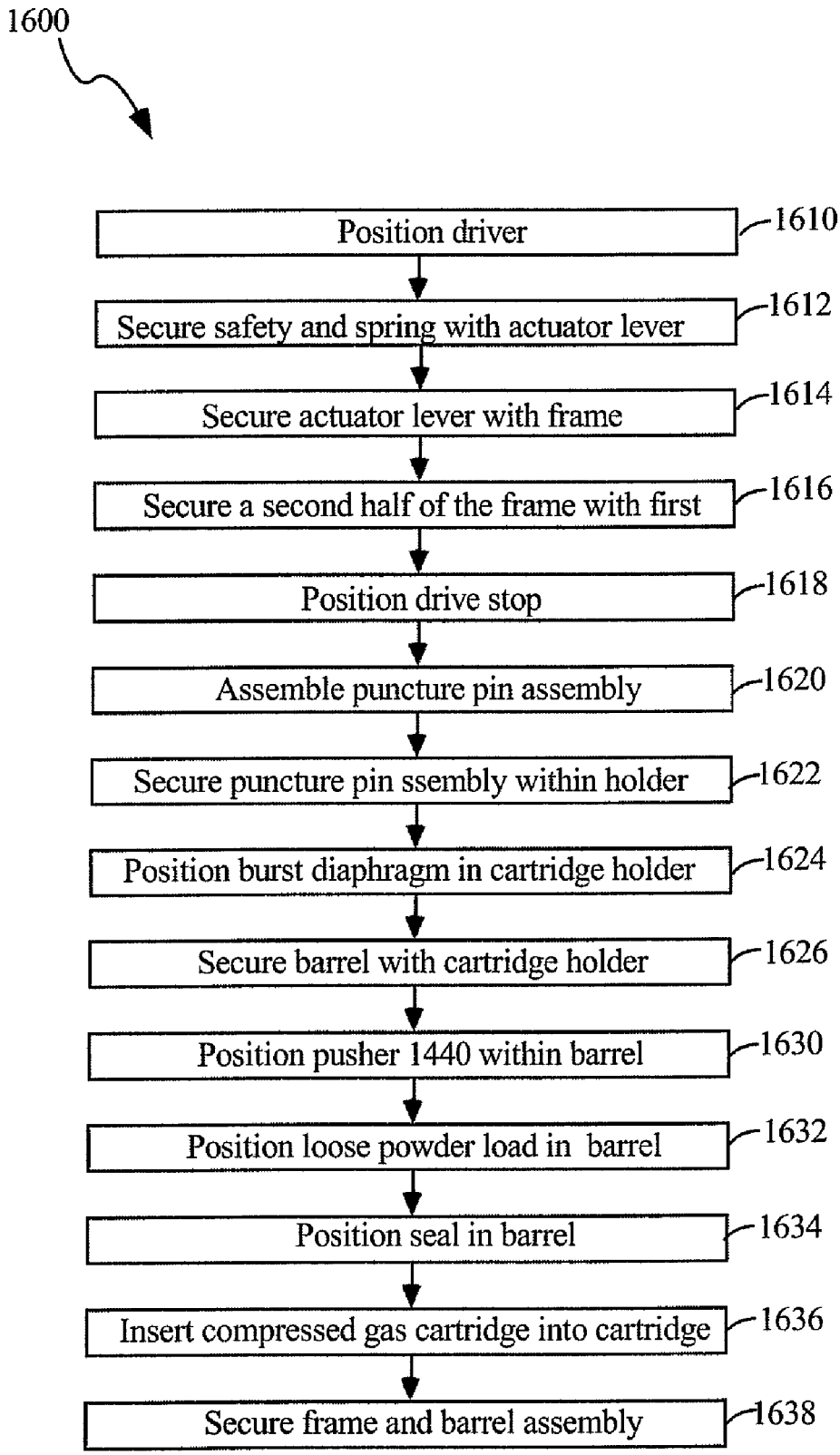
FIG. 16 depicts a simplified flow diagram of a process of assembling a launch system, such as the launch systems depicted in or more of FIGS. 6-9 and 13-15.

FIG. 16 depicts a simplified flow diagram of a process 1600 of assembling a launch system, such as the launch system 600 or 1300 of FIGS. 6-9 and 13-15, respectively. In step 1610 the driver 1418 is positioned and secured within a first half of the frame 1310. In step 1612, a safety 1314 and spring 1416 are secured with the actuator lever 1316. In step 1614, the actuator lever 1316 is positioned and pivotably secured with the frame and the driver 1418, such that the spring 1416 cooperates with the frame 1310. In step 1616, a second half of the frame is secured with the first half of the frame to maintain a positioning of the actuator lever 1316 and driver 1418. In step 1618, a driver stop 1414 is positioned within the frame 1310 to prevent the fixed fulcrum arm pair 1012 and a lever fulcrum arm 1014 from being aligned and maintaining an angle between the fixed fulcrum arm pair 1012 and a lever fulcrum arm 1014.

In step 1620 a puncture pin assembly, comprising the puncture pin 1426, a cartridge seal 914 and gas passage or tube 916 are cooperated. In step 1622 the puncture pin assembly is secured within the cartridge holder or housing 812. In step 1624 a burst diaphragm or disc 1430 is positioned relative to the expansion chamber 1428 formed in the cartridge holder 812. In some embodiments the burst diaphragm 1428 is glued or otherwise secured and/or sealed with the cartridge holder 812. In step 1626 a barrel 1422 is secured with the cartridge holder 812, for example screwed to the cartridge holder 812, with the entry opening 1432 being positioned adjacent the burst diaphragm 1428. Again, in some embodiments, the burst diaphragm 1428 is glued or otherwise secured and/or sealed with the barrel 1422. Similarly in some implementations, the barrel is a further glued with the cartridge holder 812.

In step 1630, a pusher 1440 is positioned within the barrel bore 1434 adjacent the entry opening 1432. In step 1632, the powder load 1442 is positioned within the barrel bore 1434 adjacent the pusher 1440. In step 1634, a seal 1444 is secured within the barrel bore 1434 adjacent the powder load 1442 sandwiching the unenclosed powder load between the pusher 1440 and the seal 1444. Typically, the seal 1444 is inserted into the barrel bore 1434 to a depth that will keep the powder load sealed in the barrel. Additionally, the seal can further be glued or otherwise sealed with the interior of the barrel bore in some embodiments. In step 1636 a compressed gas cartridge 1424 is inserted into the cartridge holder 812 adjacent the cartridge seal 914 and the puncture pin 1426. In some implementations, the assembled frame 1310 and the barrel assembly 1312 can be distributed separately. In other embodiments, an additional step 1638 can be implemented where the frame 1310 and the barrel assembly 1312 are detachably secured to each other prior to distribution.

Figure 17:
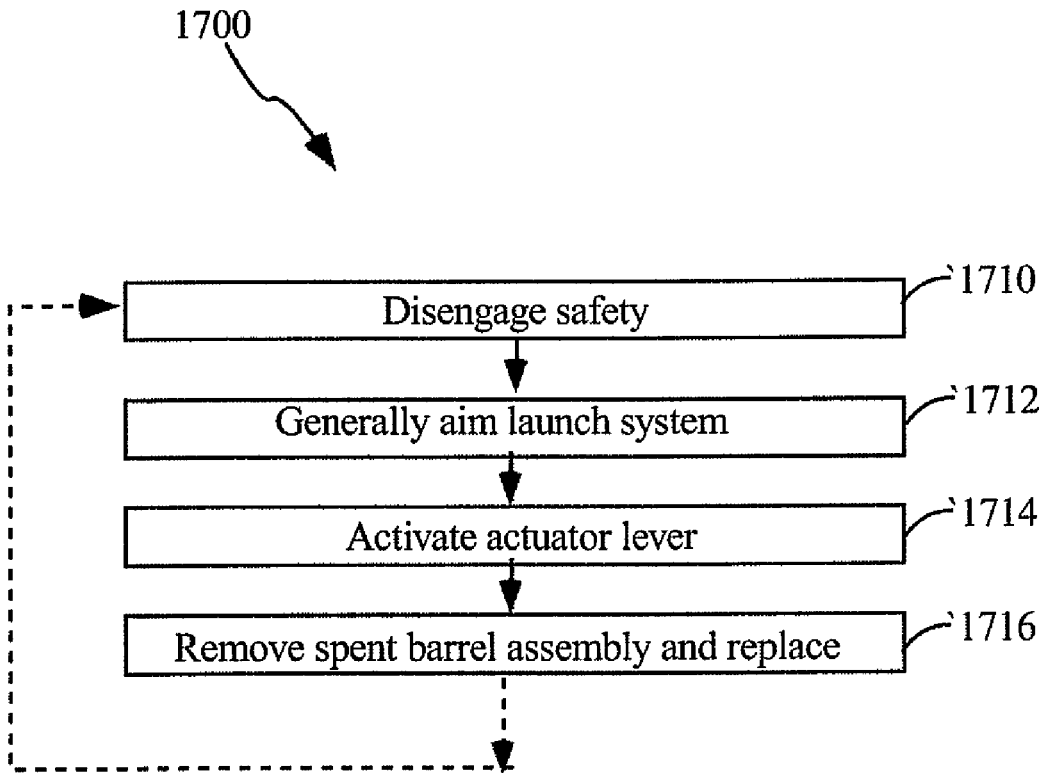
FIG. 17 depicts a simplified flow diagram of a process of activating a launch system, such as one of launch systems depicted in FIGS. 6-9 and 13-15.

FIG. 17 depicts a simplified flow diagram of a process 1700 of activating a launch system, such as one of launch systems 600 and 1300 of FIGS. 6-9 and 13-15, respectively. In step 1710, the safety 1314, when present, is disengaged. In step 1712 the launch system 1300 is generally aimed at a target. In step 1714 the actuator lever 1316 is compressed, depressed, squeezed or otherwise activated launching the load and producing a large volume, visible cloud that can potentially inhibit a target and/or provide a temporary inhibiting barrier. In some embodiments, the process 1700 further includes step 1716, where the spent barrel assembly is removed from the frame 1310 and a new barrel assembly 1312 is secured with the frame 1310. The process can terminate following one of steps 1714 or 1716, or can return to step 1712 to again generally aim the launch system for the deployment of a subsequent powder cloud 1210 to produce an additional powder cloud, effectively enlarging an inhibiting barrier and/or adding to the previous cloud. As a result, the process in some implementations activates, in response to an actuation, a source of impulse pressure, launches loose powder from a launch system, and generates a powder cloud comprising the loose powder that has dimensions larger than a human torso. Typically, the loose powder launched comprises inhibiting powder such that the powder cloud comprises an inhibiting powder cloud.

For several decades, law enforcement agencies have used various non-lethal weapons to gain control of suspects, quell riots, save hostages, etc. Most of these non-lethal deployments utilize a rather large launcher platform such as a shotgun, rifle or pistol to deploy the projectiles. Further, to date, other than pepper spray, the general public has not had access to a simple, low cost, non-lethal launcher that could be easily carried and used for personal defense at home, in the car or when on foot. The present embodiments provide low cost, compact non-lethal personal defense launch systems that can be quickly deployed and are effective on human and animal targets.

Many conventional launch systems utilize a projectile to affect the target. For example, U.S. Pat. Nos. 7,194,960, 6,546,874, 6,393,992, and 5,965,839, incorporated herein by reference in their entirety, describe many embodiments of frangible irritant powder filled projectiles, and systems to launch such projectiles, that can affect targets utilizing irritant powder clouds. These projectiles can be employed, as described above, in some present embodiments.

Further, the present embodiments series of non-lethal powder loads that can be launched by many different types of propulsion force or pressure, and from many types of launchers, to be used against a target, such as a threatening human or animal. Some of the launch systems are that can be used to launch the loose powder loads are described here. However, other launchers may be used, in some implementations. One or more such compact launch device that could be utilized to launch the loose or projectile-less irritant powder loads described herein include one or more of the launching devices described in co-pending U.S. patent application Ser. No. 11/129,230, filed May 12, 2005, to Vasel et al., and entitled COMPACT PROJECTILE LAUNCHER.

At least some embodiments of the launch systems described herein easily fit in a person's hand, a purse, pocket, glove box, and the like, and are capable of launching the loose powder loads of powder irritants, inert substances and/or marking substances. Further, these launch systems expel a cloud of irritant powder towards a target, for example, as a non-lethal defense. This irritant powder cloud typically has a distracting, incapacitating and/or repelling effect on the target, be it a human or animal, and in some instances is visible to a target further inhibiting the target. The irritant and distraction effects on the target may allow the user to retreat to a safer location, get away from an attacker, or if used by law enforcement or security personnel, subdue an individual for arrest. The propulsion force or pressure used to launch the loose powder can include, but are not limited to, compressed gas, firearm primers, gunpowder, burning hydrocarbons, chemical gas generators or other means to accelerate these non-lethal irritant powder loads towards the intended target (s). The innovative chemical loads described herein can be directly loaded in barrels attached to these many launch devices or loaded into cartridge shells that can be utilized in these or other types of launchers.

While the invention herein disclosed has been described by means of specific embodiments and applications thereof, numerous modifications and variations could be made thereto by those skilled in the art without departing from the scope of the invention set forth in the claims.

What is claimed is:

1. An apparatus for use in launching an inhibiting powder, the apparatus comprising:

a source of impulse pressure that induces a propellant pressure in gas form;

the source of impulse pressure comprising a cartridge;

a frame housing the source of impulse pressure;

a barrel stationarily secured to the frame and cooperated with the source of impulse pressure to receive the propellant pressure;

inhibiting powder positioned within the barrel;

a burst diaphragm secured between the source of the impulse pressure and the inhibiting powder;

an actuator that activates the source of impulse pressure to deliver the gas to the burst diaphragm; and a driver having a first arm and a second arm articulated one to the other at a joint, the joint being disposed adjacent to the cartridge, the actuator causing a lateral translation of the joint toward the cartridge that moves the cartridge toward a puncture member, where a bursting of the burst diaphragm results in a release of the propellant into the barrel to drive the inhibiting powder from the barrel in substantially an aerosol form generating a cloud of the inhibiting powder extending from an exit end of the barrel and out a distance from the exit end of the barrel.

2. The apparatus of claim 1, wherein the inhibiting powder is positioned within the barrel such that the inhibiting powder is in contact with an interior surface of the barrel prior to the gas being delivered into the barrel, and the inhibiting powder continues to contact the interior surface of the barrel as the inhibiting powder travels along a portion of a length of the barrel to the exit end of the barrel to be propelled out of the exit end of the barrel.

3. The apparatus of claim 1, further comprising:

an expansion chamber situated between the source of impulse pressure and the burst diaphragm, the expansion chamber receiving the gas generated by the source of impulse pressure and releasing the gas into the barrel upon achieving a burst threshold of the burst diaphragm.

4. The apparatus of claim 3, wherein the source of impulse pressure comprises:

a cartridge providing a pressurized gas;

the puncture member comprising a puncture pin positioned relative to the cartridge; and the expansion chamber positioned downstream of the puncture pin;

where the burst diaphragm is positioned between the expansion chamber and the inhibiting powder, such that upon activation the cartridge is moved toward the puncture pin causing the puncture pin to puncture the cartridge releasing the pressurized gas into the expansion chamber resulting in the burst threshold applied to the burst diaphragm to burst the burst diaphragm releasing the gas to expel the inhibiting powder from the barrel.

5. The apparatus of claim 3, further comprising:

the frame is coupled to the actuator, the actuator comprising a lever;

a barrel assembly comprising the barrel, burst diaphragm, and expansion chamber, where the barrel assembly is detachably secured with the frame; and a safety latch extensible from a free end of the lever and engaging an opening in the frame.

6. The apparatus of claim 5, wherein the propellant pressure is such to cause the cloud, generated upon propelling the inhibiting powder from the exit end of the barrel, to extend out a distance, from the exit end of the barrel at the time the inhibiting powder exits the exit end of the barrel, of greater than about 8 feet.

7. The apparatus of claim 6, wherein the propellant pressure is such to cause the cloud, within less than half a second from the loose inhibiting powder exiting the exit end of the barrel, to have a diameter that is greater than about three feet, where the diameter is generally perpendicular to an axis of the barrel and distant from a position of the exit end of the barrel at the time the inhibiting powder exits the exit end.

8. The apparatus of claim 3, further comprising:

a pusher element positioned, prior to the propellant pressure being delivered into the barrel, within the barrel proximate the inhibiting powder between the inhibiting powder and the source of propellant pressure such that the propellant pressure when delivered into the barrel is applied against the pusher element such that the pusher element drives the inhibiting powder out of the exit end of the barrel; and a seal positioned, prior to the propellant pressure being delivered into the barrel, proximate the inhibiting powder separating the inhibiting powder from an environment exterior to the barrel.

9. The apparatus of claim 1, wherein the propellant pressure is such to cause the cloud, within less than half a second from the inhibiting powder exiting the exit end of the barrel, to have a depth, from a position of the exit end of the barrel at a time the inhibiting powder is propelled from the exit end, that is greater than about five feet.

10. The apparatus of claim 1, wherein the propellant pressure is such to cause the cloud, within less than half a second from the inhibiting powder exiting the exit end of the barrel, to have dimensions, distant from a position of the exit end of the barrel at a time the inhibiting powder is propelled from the exit end, greater than an average sized adult human.

11. The apparatus of claim 1, further comprising a membrane enclosing the inhibiting powder prior to the propellant pressure being delivered into the barrel, where the membrane ruptures, due to the force of the propellant pressure delivered into the barrel, prior to the inhibiting powder exiting the barrel releasing the inhibiting powder such that the inhibiting powder contacts an interior surface of the barrel as the inhibiting powder travels along a portion of a length of the barrel to be propelled out of the barrel.

12. The apparatus of claim 1, wherein the propellant pressure is such to cause the cloud of inhibiting powder to establish a visible inhibiting barrier.

13. The system of claim 1, wherein the powder cloud is configured to flow around glasses to contact a target's eyes.

14. The system of claim 1, wherein the propellant pressure is such to cause the powder cloud to be dispersed within less than half a second from a single actuation of the actuator, to have dimensions larger than an adult human torso, and to flow around obstacles to contact a target.

15. The system of claim 14, wherein the inhibiting powder is mixed with one or more inert powdered substances.

16. The system of claim 15, wherein the inhibiting powder comprises PAVA and the one or more inert powdered substances comprise barium sulfate.

17. The system of claim 14, wherein the inhibiting powder comprises one or more of capsaicinoids or nonivamide.

18. The system of claim 1, wherein the burst diaphragm is configured to rupture and the expansion chamber has a burst opening dimensioned such that the retained impulse pressures is substantially instantaneously released into the barrel providing the propellant pressure to drive the inhibiting powder from the barrel in generating the powder cloud.

19. The system of claim 1, wherein the bursting of the burst diaphragm generates an audible retort that is readily heard by a human at a distances of greater than 20 feet.

20. The apparatus of claim 1, wherein the first arm and the second arm are articulated one to the other by being pivotably engaged to each other at the joint.

21. The apparatus of claim 1, further comprising a driver stop positioned adjacent to the joint such to cause the first arm to be disposed at an angle relative to the second joint.

22. The apparatus of claim 3, wherein the expansion chamber is formed by a plurality of expansion chambers having different diameters.

23. A method of providing an individual with protection, the method comprising:

Providing the individual with an apparatus for use in launching an inhibiting powder, the apparatus comprising, a source of impulse pressure that induces a propellant pressure in gas form;

the source of impulse pressure comprising a cartridge;

a frame housing the source of impulse pressure;

a barrel stationarily secured to the frame and cooperated with the source of impulse pressure to receive the propellant pressure the inhibiting powder being positioned within the barrel;

a burst diaphragm secured between the source of the impulse pressure and the inhibiting powder;

an actuator that activates the source of impulse pressure to deliver the gas to an expansion chamber; and a driver having a first arm and a second arm articulated one to the other at a joint, the joint being disposed adjacent to the cartridge, the actuator causing a lateral translation of the joint toward the cartridge that moves the cartridge toward a puncture pin, wherein a bursting of the burst diaphragm results in a release of the gas into the barrel to drive the inhibiting powder from the barrel in substantially an aerosol form generating a cloud of the inhibiting powder extending from an exit end of the barrel and out a distance from the exit end of the barrel;

activating, in response to an actuation, the source of impulse pressure;

launching the inhibiting powder from the apparatus; and generating a powder cloud comprising the inhibiting powder, the powder cloud having dimensions larger than a human torso.

* * * * *